US011402772B1

(12) United States Patent
Kouzu

(10) Patent No.: US 11,402,772 B1
(45) Date of Patent: Aug. 2, 2022

(54) IMAGE FORMING APPARATUS

(71) Applicant: TOSHIBA TEC KABUSHIKI KAISHA, Tokyo (JP)

(72) Inventor: Norio Kouzu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/405,209

(22) Filed: Aug. 18, 2021

(51) Int. Cl.
*G03G 15/16* (2006.01)
*G03G 21/16* (2006.01)
*G03G 15/01* (2006.01)

(52) U.S. Cl.
CPC ..... *G03G 15/1615* (2013.01); *G03G 15/0142* (2013.01); *G03G 15/161* (2013.01); *G03G 15/165* (2013.01); *G03G 15/1655* (2013.01); *G03G 21/168* (2013.01); *G03G 2221/1642* (2013.01)

(58) Field of Classification Search
CPC ..... G03G 15/0142; G03G 15/161; G03G 15/165; G03G 15/1655; G03G 15/1615; G03G 21/168; G03G 2221/1642
See application file for complete search history.

(56) References Cited

U.S. PATENT DOCUMENTS

2006/0093397 A1* 5/2006 Yamaoka ..... G03G 21/1633 399/110
2007/0212108 A1* 9/2007 Hozono ..... G03G 21/1638 399/121
2010/0003051 A1 1/2010 Sekina
2011/0069990 A1* 3/2011 Tokunaga ..... G03G 21/1647 399/121
2021/0034009 A1 2/2021 Osawa

FOREIGN PATENT DOCUMENTS

JP 2008-216595 9/2008

* cited by examiner

*Primary Examiner* — Joseph S Wong
(74) *Attorney, Agent, or Firm* — Amin, Turocy & Watson, LLP

(57) ABSTRACT

According to one embodiment, an image forming apparatus includes an apparatus body, a transfer unit body, a transfer counter roller, a transfer belt, a side cover, a transfer roller, a shaft end member, and a holding member. The side cover is opened and closed with respect to the apparatus body. The transfer roller is supported by the side cover, moves between an abutting position at which the transfer roller comes into contact with the transfer belt and interposes the transfer belt along with the transfer counter roller and a separate position at which the transfer roller is separated from the transfer belt. The shaft end member is provided at a shaft end of the transfer roller. The holding member is provided in the transfer unit body, holds the shaft end member at the abutting position, and opens the shaft end member at the separate position.

20 Claims, 14 Drawing Sheets

IMAGE FORMING APPARATUS

FIELD

Embodiments described herein relate generally to an image forming apparatus, a roller assembly, and methods associated therewith.

BACKGROUND

In an image forming apparatus, an elastic member such as a spring is used for pressurization between a secondary transfer roller and a transfer belt on a secondary transfer counter roller.

DETAILED DESCRIPTION

In general, according to one embodiment, an image forming apparatus includes an apparatus body, a transfer unit body, a transfer counter roller, a transfer belt, a side cover, a transfer roller, a shaft end member, and a holding member. The transfer counter roller is supported by the transfer unit body. The transfer belt is suspended on the transfer counter roller and on which an image is formed. The side cover is opened and closed with respect to the apparatus body. The transfer roller is supported by the side cover, moves between an abutting position at which the transfer roller comes into contact with the transfer belt and interposes the transfer belt along with the transfer counter roller and a separate position at which the transfer roller is separated from the transfer belt, and pivots with respect to the side cover. The shaft end member is provided at a shaft end of the transfer roller. The holding member is provided in the transfer unit body, holds the shaft end member at the abutting position, and opens the shaft end member at the separate position.

An image forming apparatus 10 according to an embodiment will be described with reference to FIGS. 1 to 14.

Figure 1:
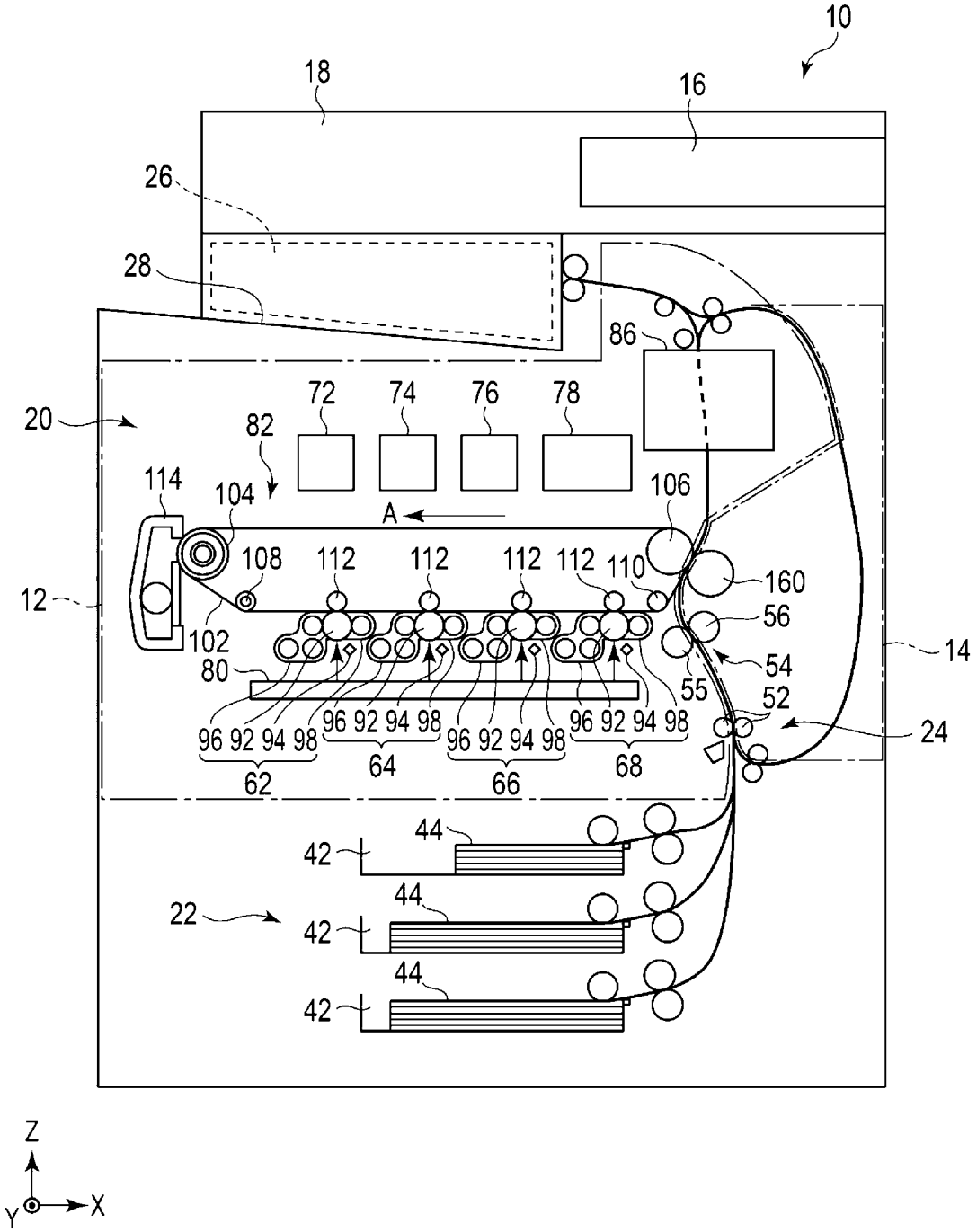
FIG. 1 is a view schematically illustrating an overall configuration of an image forming apparatus according to an embodiment.

FIG. 1 is a view schematically illustrating an overall configuration of the image forming apparatus 10 according to the embodiment. In the image forming apparatus 10, the front side of FIG. 1 is referred to as a front side of the image forming apparatus 10 and the rear side of FIG. 1 is referred to as a rear side of the image forming apparatus 10. To describe a relative positional relation between units of the image forming apparatus 10, the XYZ rectangular coordinate system is taken in the image forming apparatus 10, as illustrated in FIG. 1. The +X axis side is a direction oriented from the left to the right if the image forming apparatus 10 stands on the front side (the nearside of FIG. 1). That is, the X axis is oriented along the left and right directions. The +Y axis side is a direction oriented from the rear side to the front side of the image forming apparatus 10. That is, the Y axis is oriented along the front and rear directions. The +Z axis side is an upward perpendicular direction. That is, the Z axis is oriented along the upper and lower directions.

Figure 2:
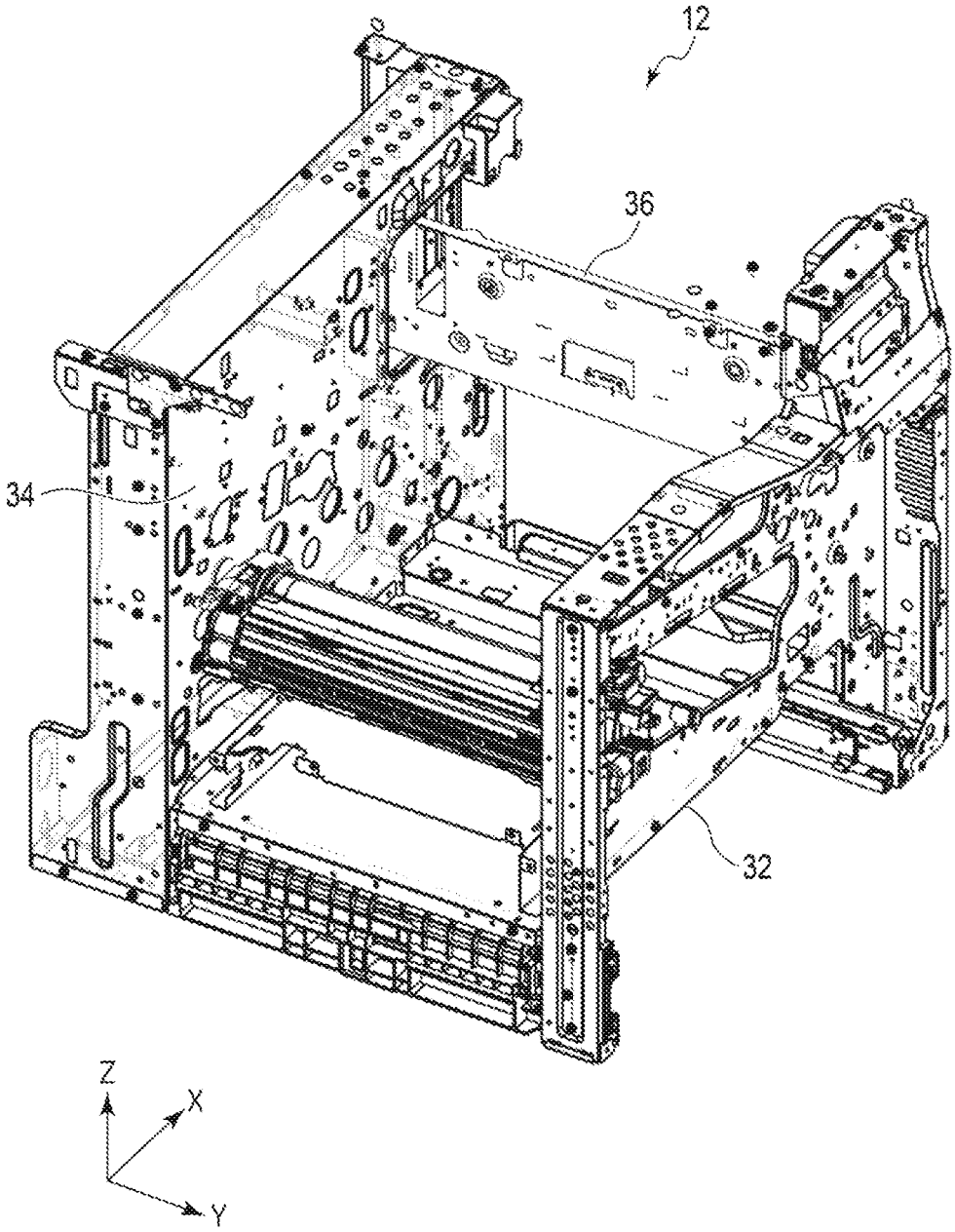
FIG. 2 is a schematic perspective view illustrating an apparatus body of the image forming apparatus.
Figure 3:
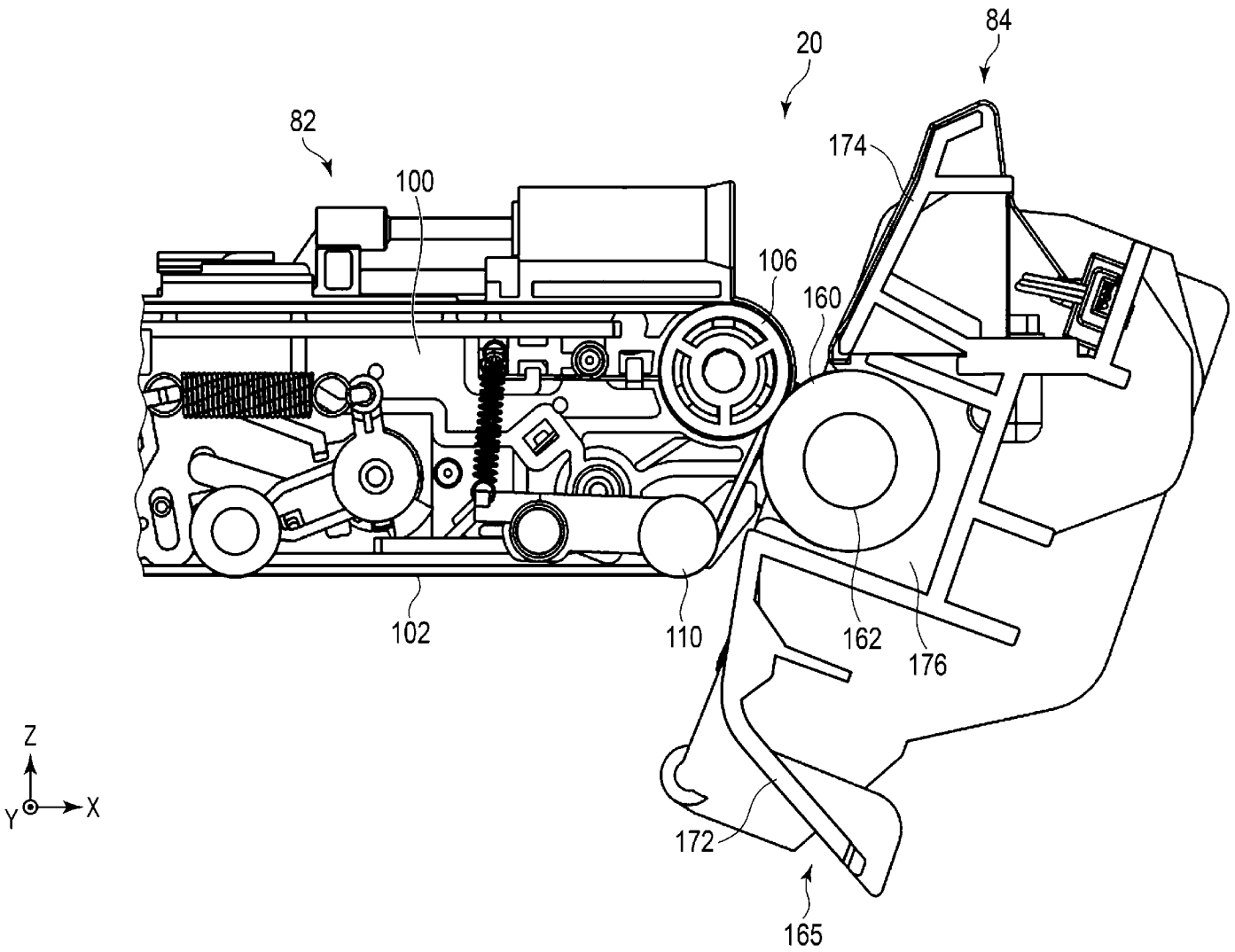
FIG. 3 is a schematic view illustrating the configuration in which a part of a printer of the image forming apparatus is viewed from the front side.

FIG. 2 is a schematic perspective view illustrating an apparatus body 12. FIG. 3 illustrates a part of a printer 20 of the image forming apparatus 10. FIG. 3 illustrates a state in which the outer circumferential surface of a second transfer roller 160 is at an abutting position at which the circumferential surface comes into contact with a transfer belt (an image carrying belt) 102 on a secondary transfer counter roller 106.

Figure 4:
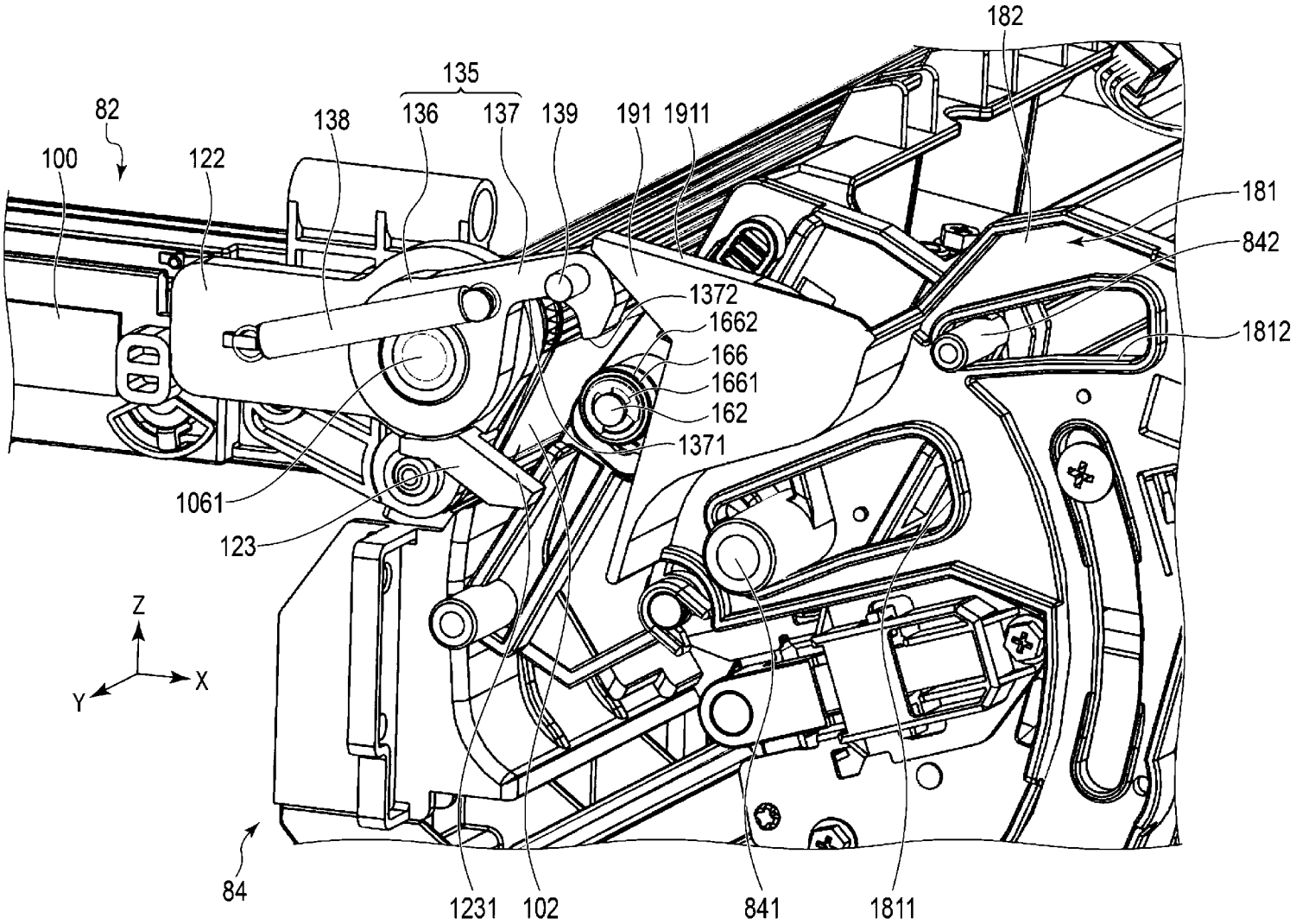
FIG. 4 is a schematic perspective view illustrating the part of the printer of the image forming apparatus illustrated in FIG. 3 when viewed from the front side.
Figure 5:
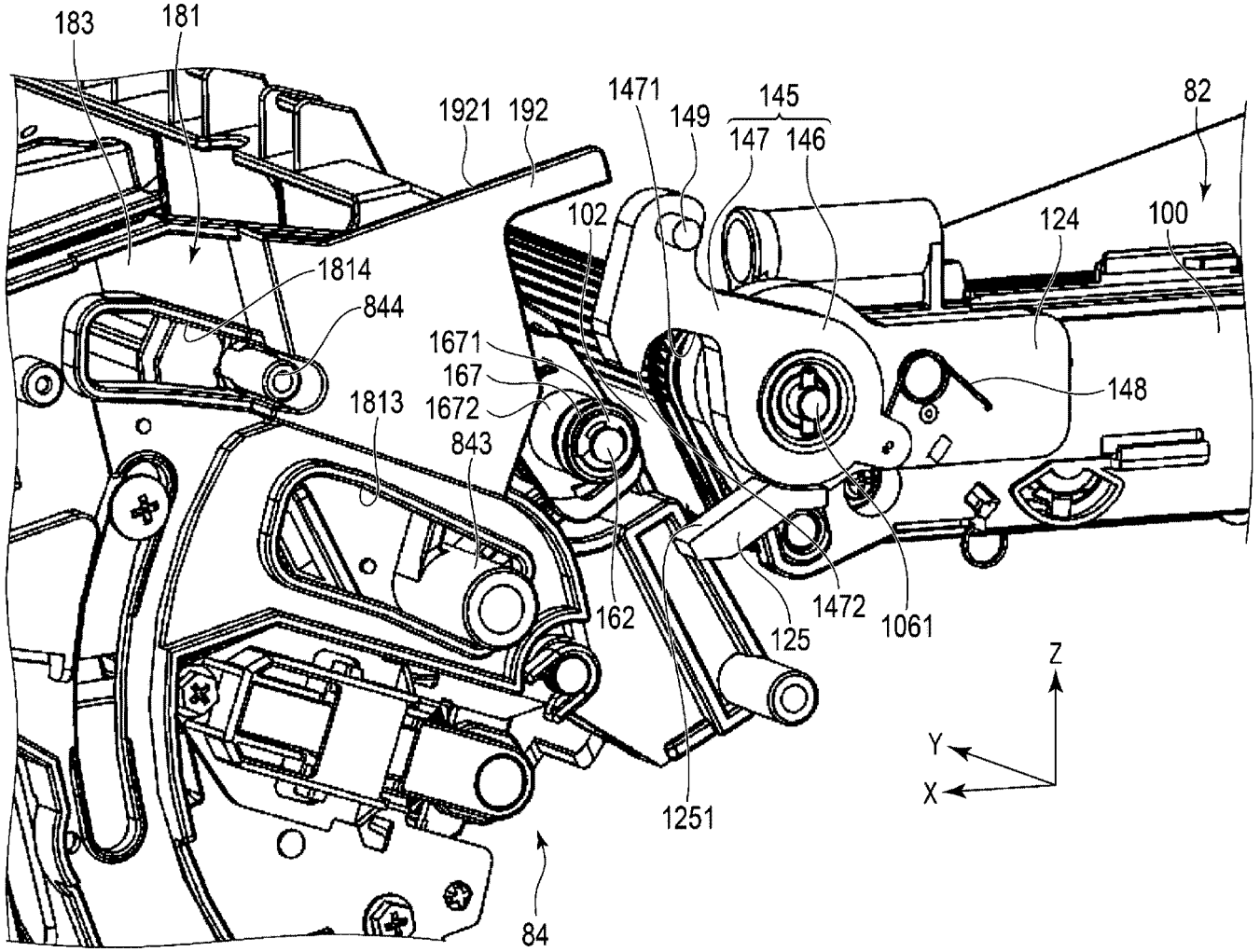
FIG. 5 is a schematic perspective view illustrating the part of the printer of the image forming apparatus illustrated in FIG. 3 when viewed from the rear side.

FIG. 4 is a schematic perspective view illustrating the part of the printer 20 of the image forming apparatus 10 illustrated in FIG. 3 when viewed from the front side. FIG. 5 is a schematic perspective view illustrating the part of a printer 20 of the image forming apparatus 10 illustrated in FIG. 3 when viewed from the rear side. FIGS. 4 and 5 illustrate a state in which the outer circumferential surface of the secondary transfer roller 160 is at a separate position at which the outer circumferential surface is separated from the transfer belt 102.

Figure 6:
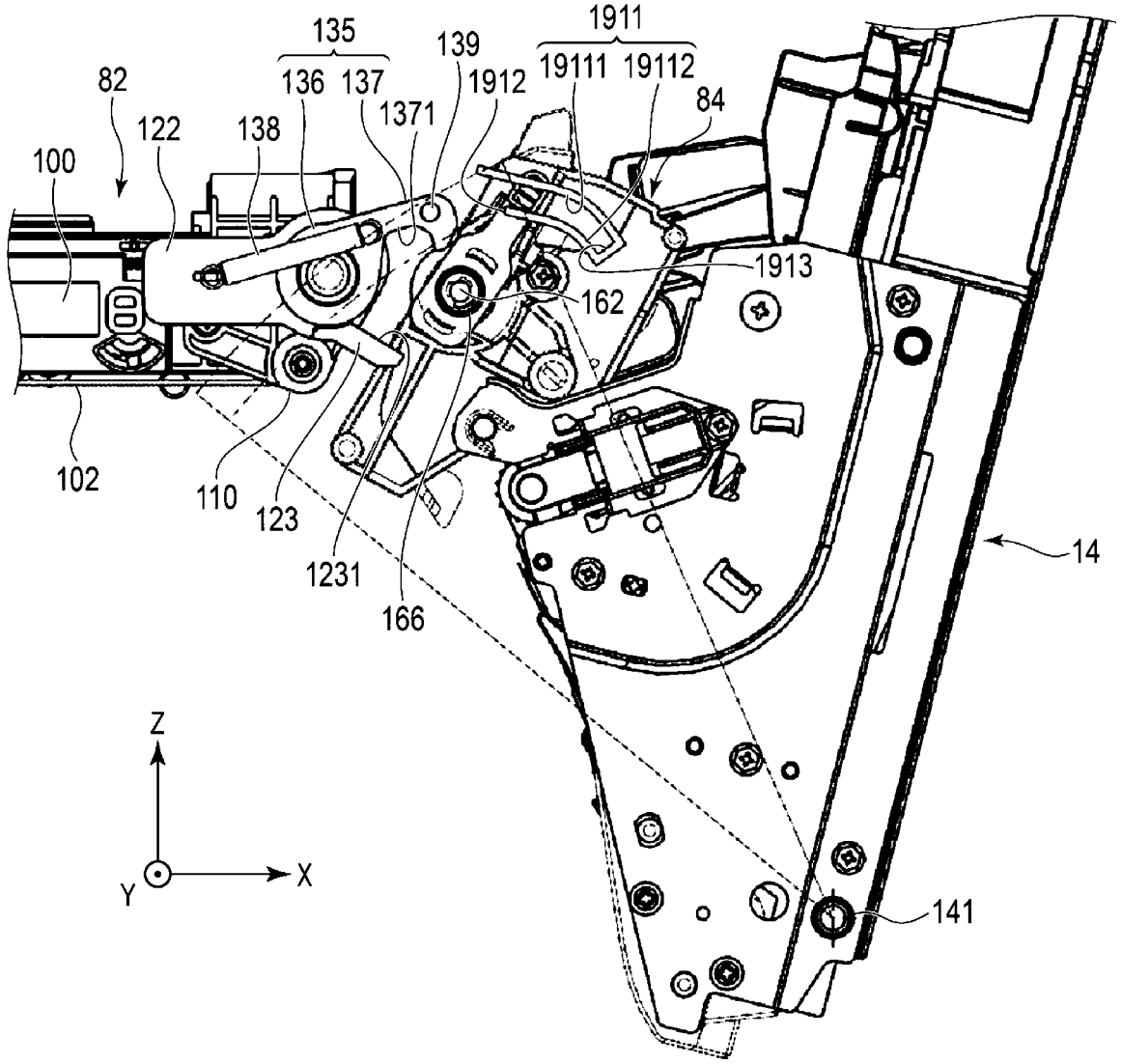
FIG. 6 is a schematic view illustrating a side cover and parts of a transfer unit, a secondary transfer roller unit, and a buffer unit of the printer when viewed from the front side in a state in which the side cover is opened with respect to the apparatus body of the image forming apparatus.
Figure 7:
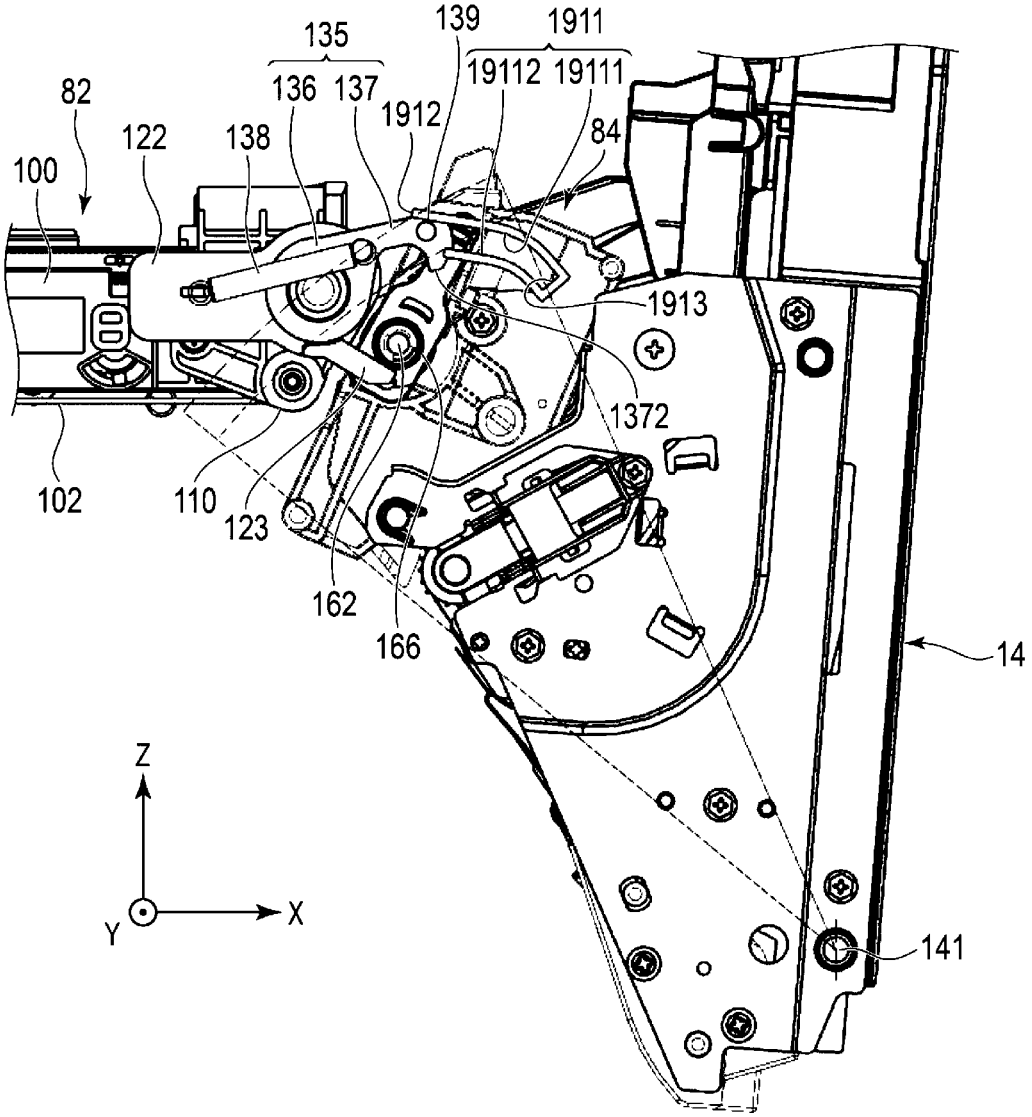
FIG. 7 is a schematic view illustrating the side cover and the transfer unit, the secondary transfer roller unit, and the buffer unit of the printer when viewed from the front side in a state in which the side cover is moved with respect to the apparatus body of the image forming apparatus from the position illustrated in FIG. 6 to a direction in which the side cover is closed.
Figure 8:
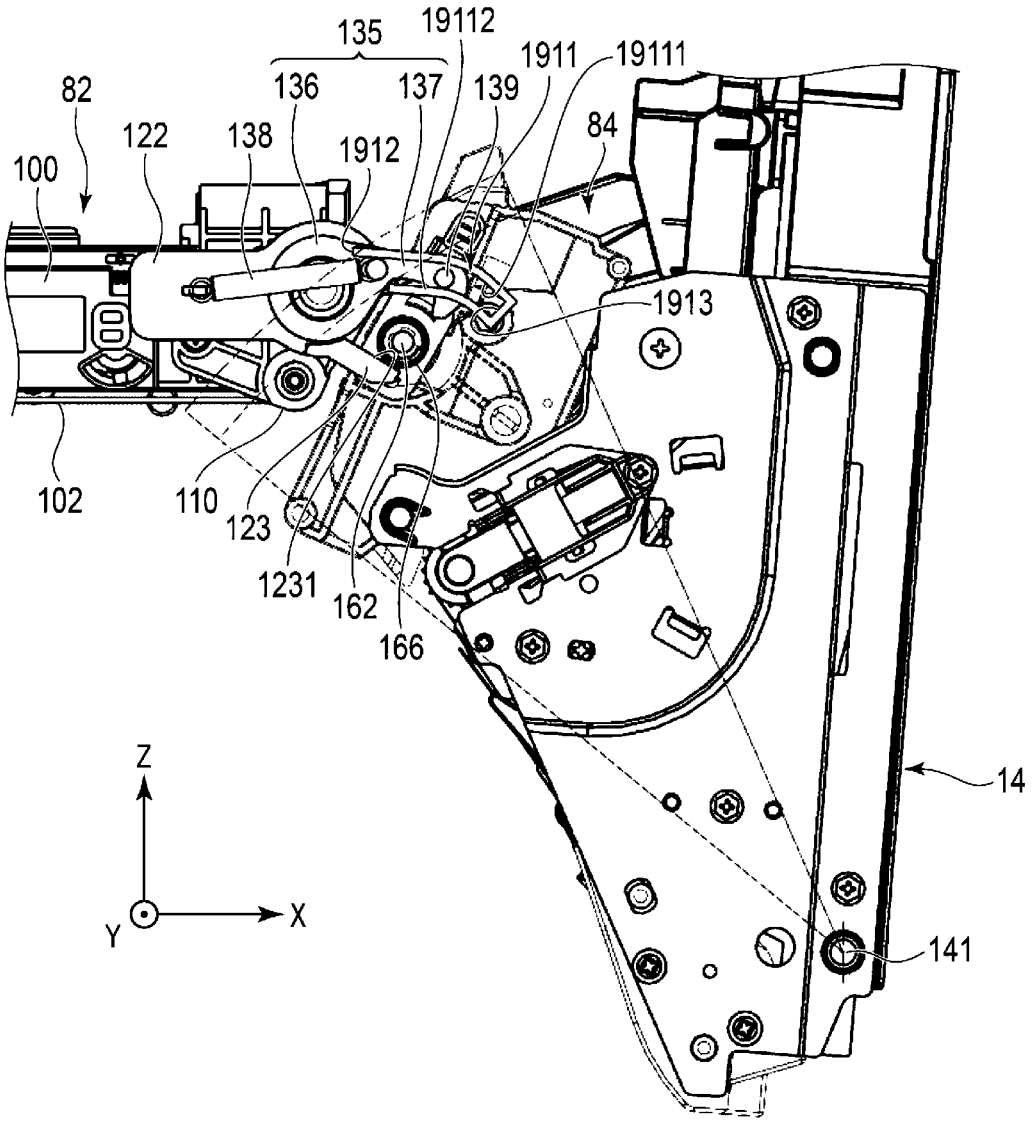
FIG. 8 is a schematic view illustrating the side cover and the transfer unit, the secondary transfer roller unit, and the buffer unit of the printer when viewed from the front side in an operation of the buffer unit from the position illustrated in FIG. 7 to the left in a state in which the side cover is held at a position illustrated in FIG. 7 with respect to the apparatus body of the image forming apparatus.

FIG. 6 is a schematic view illustrating a side cover 14 and a transfer unit 82, a secondary transfer roller unit 84, and a buffer unit 181 of the printer 20 when viewed from the front side in a state in which the side cover 14 is opened with respect to the apparatus body 12 of the image forming apparatus 10. FIG. 7 is a schematic view illustrating the side cover 14 and the transfer unit 82, the secondary transfer roller unit 84, and the buffer unit 181 of the printer 20 when viewed from the front side in a state in which the side cover 14 is moved with respect to the apparatus body 12 of the image forming apparatus 10 from the position illustrated in FIG. 6 in a direction in which the side cover 14 is closed. FIG. 8 is a schematic view illustrating the side cover 14 and the transfer unit 82, the secondary transfer roller unit 84, and the buffer unit 181 of the printer 20 when viewed from the front side in movement of the buffer unit 181 from the position illustrated in FIG. 7 in a state in which the side cover 14 is held at a position illustrated in FIG. 7 with respect to the apparatus body 12 of the image forming apparatus 10. FIGS. 6 to 8 illustrate a state in which the outer circumferential surface of the secondary transfer roller 160 is at a separate position at which the outer circumferential surface is separated from the transfer belt 102.

Figure 9:
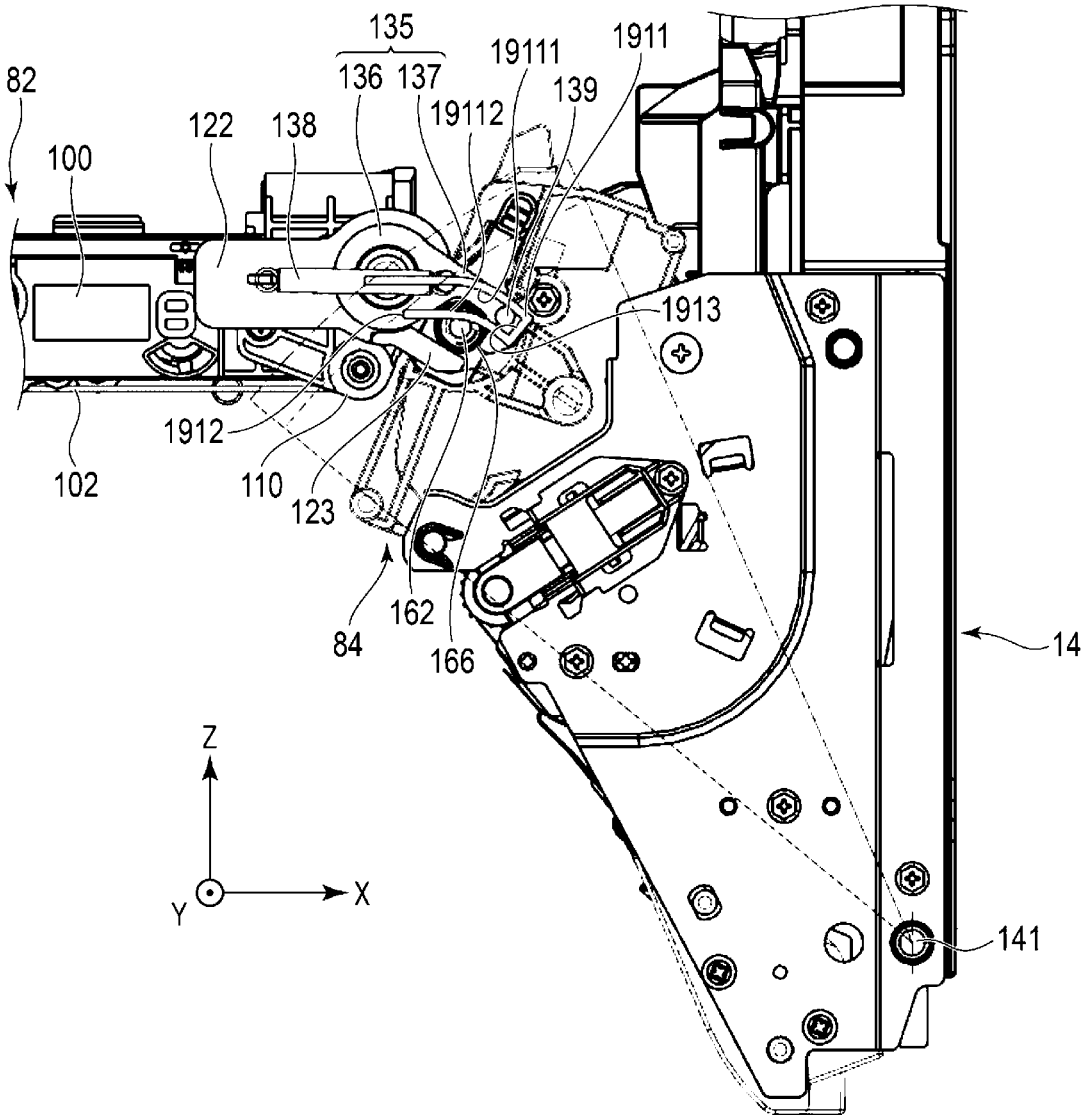
FIG. 9 is a schematic view illustrating the side cover and the transfer unit, the secondary transfer roller unit, and the buffer unit of the printer when viewed from the front side in a state in which the side cover is closed with respect to the apparatus body of the image forming apparatus.

FIG. 9 is a schematic view illustrating the side cover 14 and the transfer unit 82, the secondary transfer roller unit 84, and the buffer unit 181 of the printer 20 when viewed from the front side in a state in which the side cover 14 is closed with respect to the apparatus body 12 of the image forming apparatus 10. FIG. 9 illustrates a state in which the outer circumferential surface of the secondary transfer roller 160 is at an abutting position coming at which the outer circumferential surface comes into contact with the transfer belt 102 on the secondary transfer counter roller 106.

Figure 10:
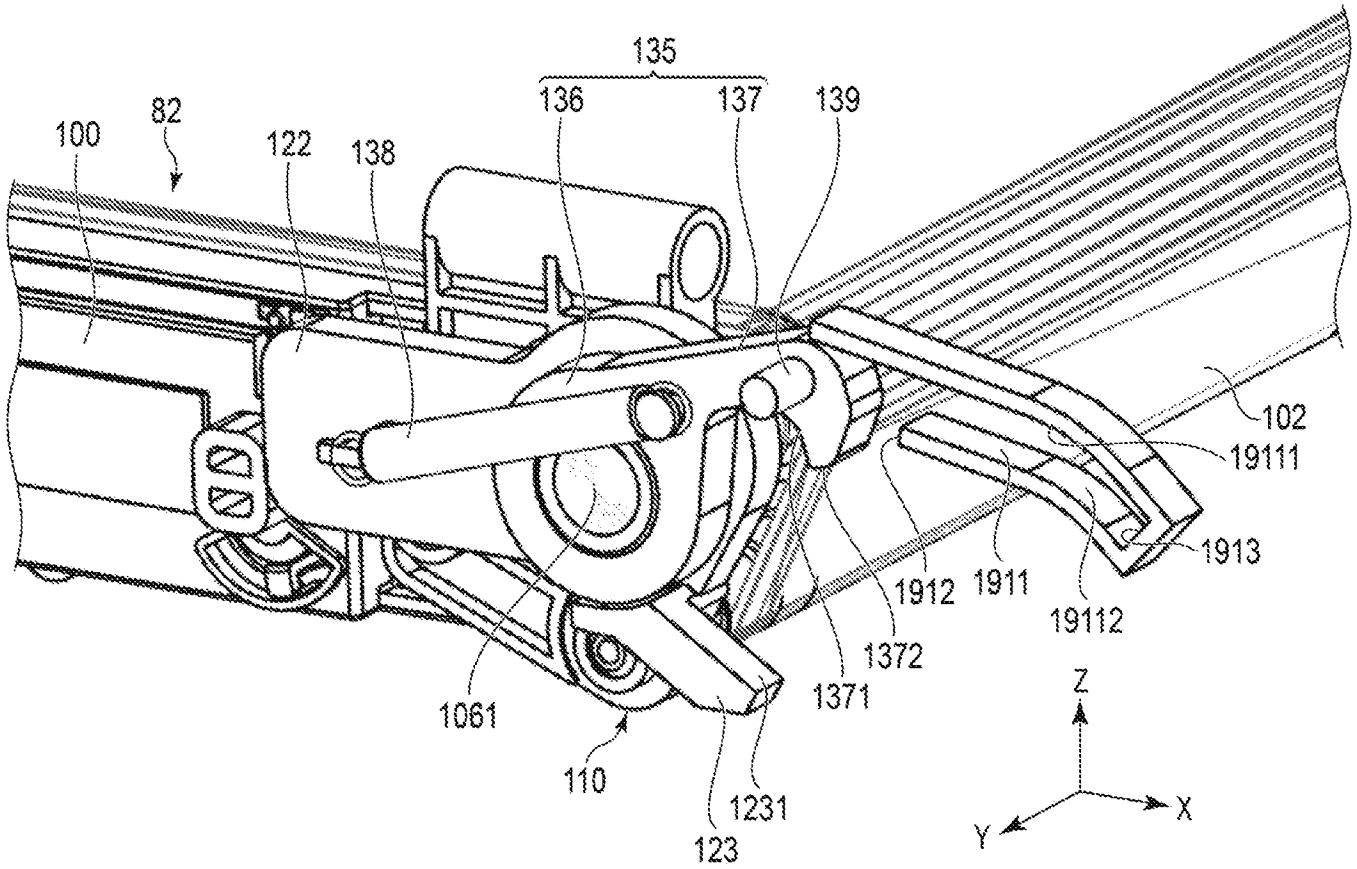
FIG. 10 is a schematic perspective view illustrating the parts of the transfer unit and the buffer unit of the printer illustrated in FIG. 6 when viewed from the front side.

FIG. 10 is a schematic perspective view illustrating the parts of the transfer unit 82 and the buffer unit 181 of the printer 20 illustrated in FIG. 6 when viewed from the front side. In FIG. 10, the side cover 14 and the transfer unit 82, the secondary transfer roller unit 84, and the buffer unit 181 of the printer 20 are partially or entirely omitted. FIG. 10 illustrates a state in which the outer circumferential surface of the secondary transfer roller 160 is at a separate position at which the outer circumferential surface is separated from the transfer belt 102.

Figure 11:
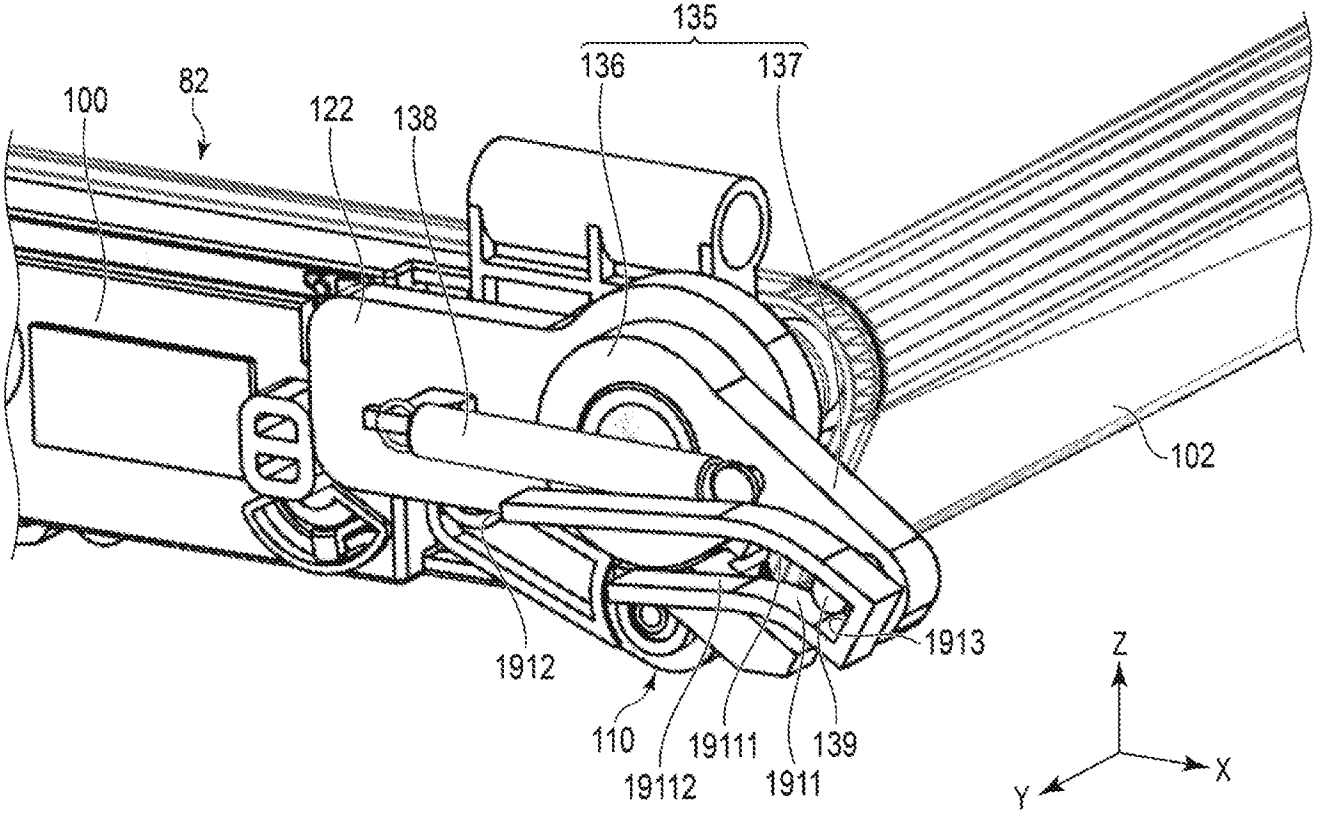
FIG. 11 is a schematic perspective view illustrating the parts of the transfer unit and the buffer unit of the printer illustrated in FIG. 9 when viewed from the front side.

FIG. 11 is a schematic perspective view illustrating the parts of the transfer unit 82 and the buffer unit 181 of the printer 20 illustrated in FIG. 9 when viewed from the front side. In FIG. 11, the side cover 14 and the transfer unit 82, the secondary transfer roller unit 84, and the buffer unit 181 of the printer 20 are partially or entirely omitted. FIG. 11 illustrates a state in which the outer circumferential surface of the secondary transfer roller 160 is at an abutting position coming at which the outer circumferential surface comes into contact with the transfer belt 102 on the secondary transfer counter roller 106.

Figure 12:
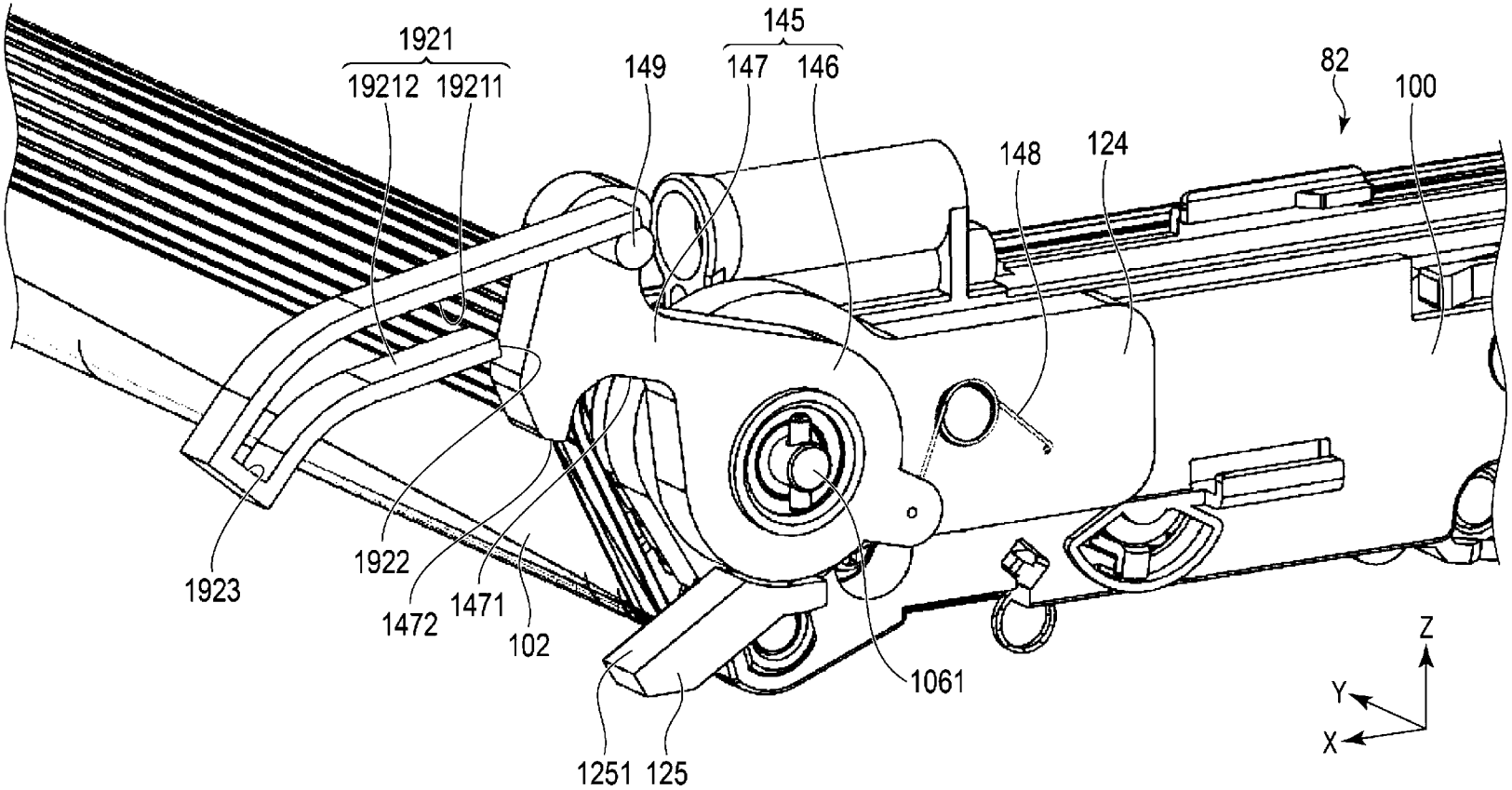
FIG. 12 is a schematic perspective view illustrating the parts of the transfer unit and the buffer unit of the printer illustrated in FIG. 6 when viewed from the rear side.

FIG. 12 is a schematic perspective view illustrating the parts of the transfer unit 82 and the buffer unit 181 of the printer 20 illustrated in FIG. 6 when viewed from the rear side. In FIG. 12, the side cover 14 and the transfer unit 82, the secondary transfer roller unit 84, and the buffer unit 181 of the printer 20 are partially or entirely omitted. FIG. 12 illustrates a state in which the outer circumferential surface of the secondary transfer roller 160 is at a separate position at which the outer circumferential surface is separated from the transfer belt 102.

Figure 13:
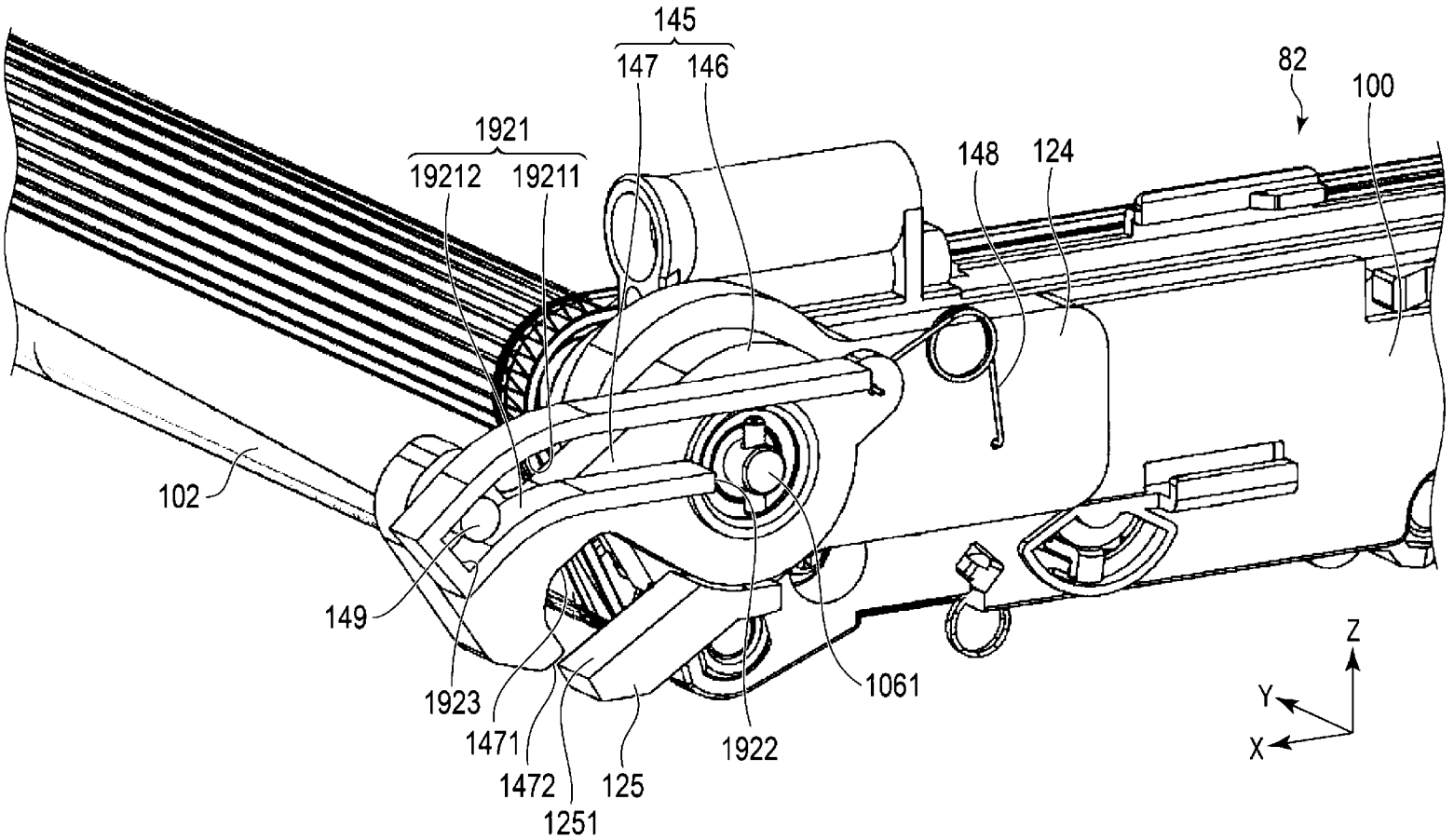
FIG. 13 is a schematic perspective view illustrating the parts of the transfer unit and the buffer unit of the printer illustrated in FIG. 9 when viewed from the rear side.

FIG. 13 is a schematic perspective view illustrating the parts of the transfer unit 82 and the buffer unit 181 of the printer 20 illustrated in FIG. 9 when viewed from the rear side. In FIG. 13, the side cover 14 and the transfer unit 82, the secondary transfer roller unit 84, and the buffer unit 181 of the printer 20 are partially or entirely omitted. FIG. 13 illustrates a state in which the outer circumferential surface of the secondary transfer roller 160 is at an abutting position coming at which the outer circumferential surface comes into contact with the transfer belt 102 on the secondary transfer counter roller 106.

Figure 14:
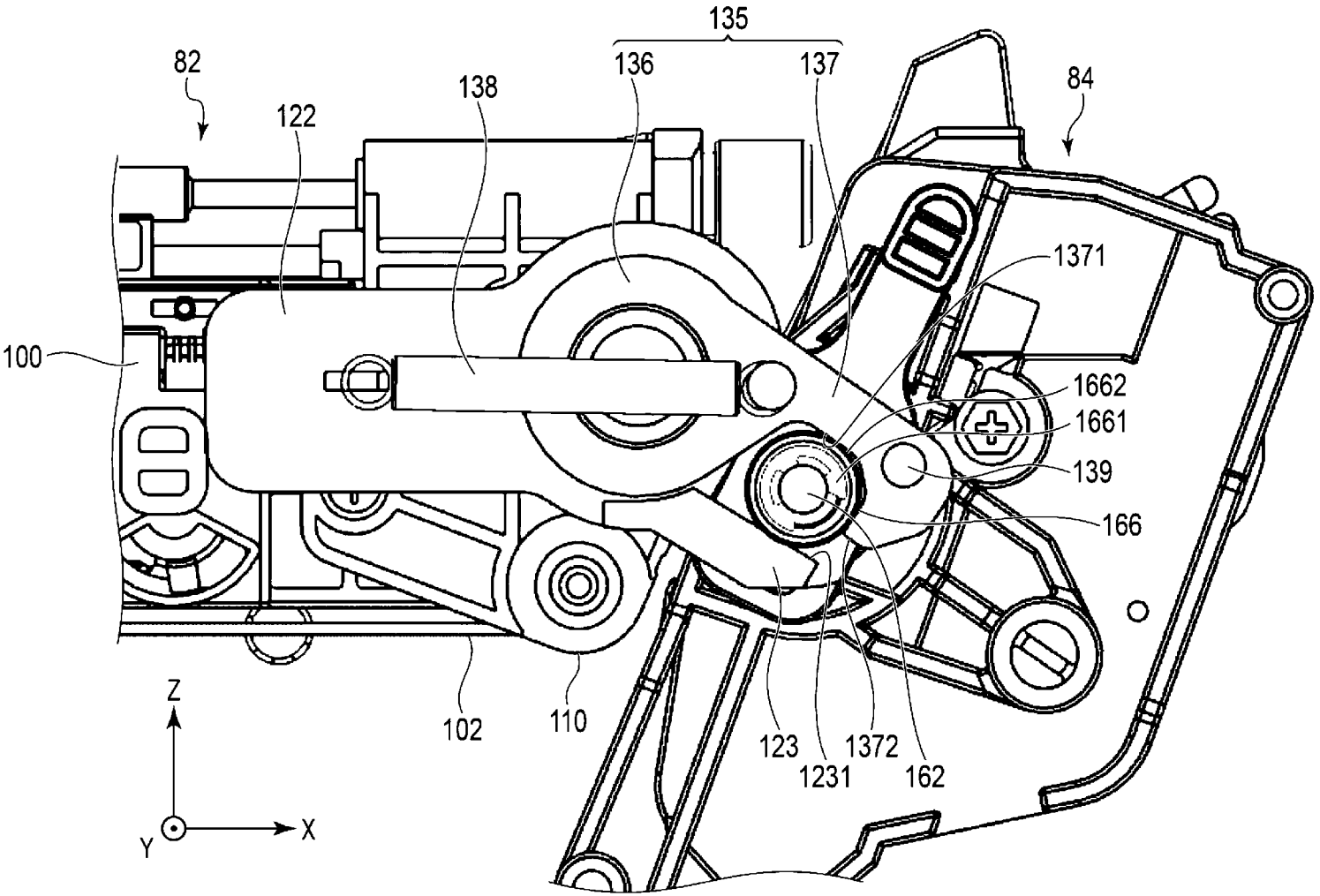
FIG. 14 is a schematic view illustrating parts of the transfer unit and the secondary transfer roller unit of the printer illustrated in FIG. 9 when viewed from the front side.

FIG. 14 is a schematic view illustrating parts of the transfer unit 82 and the secondary transfer roller unit 84 of the printer 20 illustrated in FIG. 9 when viewed from the front side. In FIG. 14, the side cover 14 and the transfer unit 82, the secondary transfer roller unit 84, and the buffer unit 181 of the printer 20 are partially or entirely omitted.

As illustrated in FIG. 1, the image forming apparatus 10 according to the embodiment includes the apparatus body 12, the side cover 14, a control panel 16, a scanner unit 18, the printer 20, the sheet supply unit 22, a conveyance unit 24, and a control unit 26.

As illustrated in FIG. 2, the apparatus body 12 is a frame of the image forming apparatus 10. The apparatus body 12 includes a front frame 32 and a rear frame 34. The front frame 32 is on the +Y axis side of the printer 20. The rear frame 34 is on the −Y axis side of the printer 20. The front frame 32 and the rear frame 34 are connected by a connection unit 36 extending along the Y axis.

As illustrated in FIGS. 1 and 3, the side cover 14 is, for example, at the end of the apparatus body 12 on the +X axis side. The surface of the side cover 14 on the +X axis side is a lateral surface of the image forming apparatus 10 on the +X axis side. The side cover 14 pivots around an openable shaft (pivoting point) 141 parallel to the Y axis within a predetermined angle range. The side cover 14 is opened and closed with respect to the apparatus body 12 if a user operates an operation unit such as a knob or a lever.

As illustrated in FIG. 1, the sheet supply unit 22 is in the lower portion of the apparatus body 12 on the −Z axis side. The conveyance unit 24 is in the upper right direction (the +X axis side and the +Z axis side) of the sheet supply unit 22. The printer 20 is on the upper side (the +Z axis side) of the sheet supply unit 22. The control unit 26 and a discharging tray 28 are on the upper side (the +Z axis side) of the printer 20.

The control panel 16 and the scanner unit 18 are above an upper end of the apparatus body 12 on the +z axis side.

The sheet supply unit 22 includes, for example, a plurality of feeding cassettes 42 that accommodate many sheets 44. The sheet supply unit 22 picks up the sheets 44 necessary to form images from each feeding cassette 42 one by one. The sheet supply unit 22 supplies the picked-up sheet 44 to the conveyance unit 24.

The conveyance unit 24 includes a conveyance roller 52 and a resist roller 54. The conveyance roller 52 and the resist roller 54 convey the sheet 44 supplied from the feeding cassette 42 of the sheet supply unit 22 to the printer 20.

The conveyance unit 24 switches a closing position (a use position) and an opening position (a maintenance position) of the conveyance unit 24 in accordance with a positional relation between the apparatus body 12 and the side cover 14. A portion of the conveyance unit 24 on the −X axis side is in the apparatus body 12. A portion of the conveyance unit 24 on the +X axis side is in the side cover 14.

The printer 20 transfers and fixes, for example, an image read by the scanner unit 18 to the sheet 44 conveyed by the conveyance unit 24. The conveyance unit 24 discharges the sheet 44 to which the image is fixed in the printer 20 to the discharging tray 28.

The printer 20 includes image forming units 62, 64, 66, and 68, toner cartridges 72, 74, 76, and 78, an exposure unit 80, a transfer unit 82, a secondary transfer roller unit 84, and a fixing unit 86.

The image forming units 62, 64, 66, and 68, the toner cartridges 72, 74, 76, and 78, the exposure unit 80, the transfer unit 82, and the fixing unit 86 of the printer 20 are in the apparatus body 12. The apparatus body 12 regulates movement in the ±X axis side and the ±Z axis side if the image forming units 62, 64, 66, and 68, the toner cartridges 72, 74, 76, and 78, the exposure unit 80, the transfer unit 82, and the fixing unit 86 are in the apparatus body 12.

The toner cartridges 72, 74, 76, and 78 of the printer accommodate yellow, magenta, cyan, and black toner, respectively. The toner cartridges 72, 74, 76, and 78 supply the toner to the image forming units 62, 64, 66, and 68, respectively, through toner supply pipes. The image forming units 62, 64, 66, and 68 form images (toner images) using the different toner supplied from the toner cartridges 72, 74, 76, and 78, respectively. That is, the image forming units 62, 64, 66, and 68 form yellow, magenta, cyan, and black toner images, respectively. The image forming units 62, 64, 66, and 68 have the same configuration except for a difference in the toner to be used.

Each of the image forming units 62, 64, 66, and 68 includes a photosensitive drum 92, a charger 94, a developing unit 96, and a cleaner 98.

The photosensitive drum 92 is an image carrier that forms a latent image. The photosensitive drum 92 includes a photoreceptor on its outer circumferential surface. The charger 94 uniformly charges the outer circumferential surface of the photosensitive drum 92.

The developing unit 96 develops an electrostatic latent image formed on the photosensitive drum 92 with the toner to form a toner image. The printer 20 primarily transfers the formed toner image to the transfer belt 102 to be described below in the transfer unit 82. The cleaner 98 removes the toner attached to the photosensitive drum 92 after the primary transfer.

The exposure unit 80 includes a light source such as a laser or an LED. Image information corresponding to yellow, magenta, cyan, and black is supplied to each exposure unit 80. The exposure unit 80 selectively radiates light to the photosensitive drums 92 of the image forming units 62, 64, 66, and 68 in accordance with the image information. The image forming units 62, 64, 66, and 68 form the electrostatic latent images corresponding to yellow, magenta, cyan, and black on the outer circumferential surfaces of the photosensitive drums 92, respectively.

As illustrated in FIGS. 1 and 3, the transfer unit 82 includes a transfer unit body 100, a transfer belt 102, a transfer belt roller 104, the secondary transfer counter roller 106, a support roller 108, a belt suspended roller 110, and four primary transfer rollers 112. The transfer belt 102, the transfer belt roller 104, the secondary transfer counter roller 106, the support roller 108, the belt suspended roller 110, and the four primary transfer rollers 112 are in the transfer unit body 100.

The transfer belt 102 is an endless belt. The transfer belt 102 is an intermediate transfer body on which the toner images are formed by the image forming units 62, 64, 66, and 68.

The transfer belt roller 104, the secondary transfer counter roller 106, the support roller 108, and the belt suspended roller 110 give a tensile force to the transfer belt 102 to support the transfer belt 102. The transfer belt roller 104, the secondary transfer counter roller 106, the support roller 108, and the belt suspended roller 110 rotate around central axes parallel to the Y axis. The transfer belt roller 104 is rotated to rotate the transfer belt 102 in a direction of an arrow A. The secondary transfer counter roller 106, the support roller 108, and the belt suspended roller 110 follow the circulation of the transfer belt 102 to rotate.

The image forming units 62, 64, 66, and 68 are located in this order in the direction of the arrow A in which the transfer belt 102 rotates.

The transfer belt 102 is suspended on the belt suspended roller 110. The belt suspended roller 110 gives an urging force from the inside to the outside of the transfer belt 102.

The primary transfer rollers 112 face the image forming units 62, 64, 66, and 68 with the transfer belt 102 with interposed therebetween. The primary transfer roller 112 gives a transfer bias in synchronization with the photosensitive drum 92. The primary transfer rollers 112 primarily transfer the toner images formed on the photosensitive drums 92 of the image forming units 62, 64, 66, and 68 to the transfer belt 102. The toner images formed by the image forming units 62, 64, 66, and 68 are moved in synchronization with the movement of the transfer belt 102. The image forming units 62, 64, 66, and 68 superimpose and transfer the toner images on the transfer belt 102.

The transfer unit 82 includes a cleaner 114. The cleaner 114 removes the toner attached to the transfer belt 102.

As illustrated in FIG. 4, a first base 122 is provided in the transfer unit body 100 of the transfer unit 82. The first base 122 may be integrated with the transfer unit body 100. The first base 122 covers at least a part of the front side portion (an +Y axis side end) of each of the transfer belt 102, the secondary transfer counter roller 106, and the belt suspended roller 110. In the embodiment, the first base 122 covers the +Y axis side end which is the front side portion of a pivoting shaft 1061 of the secondary transfer counter roller 106. The first base 122 faces the front frame 32 of the apparatus body 12. The front frame 32 may support the first base 122 along with the transfer unit body 100 or instead of the transfer unit body 100.

The first base 122 includes a first extension portion 123 extending toward the side cover 14 on the right side (the +X axis side) from the transfer unit body 100. The first extension portion 123 is provided at the +Y axis side end which is the front side portion of the secondary transfer counter roller 106. The first extension portion 123 includes a support surface (a guide surface) 1231 that supports a shaft end member 166. The support surface 1231 is formed as a slope surface or a curved surface extending in the +X axis direction and the −Z axis direction.

In the first base 122, a first holding member 135 that pivots with respect to the first base 122 is supported. The first holding member 135 pivots around the same pivoting shaft as the pivoting shaft 1061 of the secondary transfer counter roller 106, for example.

The first holding member 135 includes a pivoting body 136 that pivots around the shaft of the secondary transfer counter roller 106 and a hook 137 that is provided in the pivoting body 136, extends from the pivoting body 136 to the side cover 14, that is, in the +X axis direction, and holds the shaft end member 166. The hook 137 includes a recessed surface 1371 that supported the shaft end member 166 of the secondary transfer roller 160 interposed with the support surface 1231 of the first extension portion 123 and a protrusion 1372 that extends toward the −Z axis side on the +X axis side of the recessed surface 1371.

An urging member 138 that supports the first holding member 135 with respect to the first base 122 is provided between the first base 122 and the first holding member 135. One end of the urging member 138 is supported at a position on the −X axis direction from the pivoting shaft of the secondary transfer counter roller 106. The other end of the urging member 138 is supported at a position in the +X axis direction and the +Z axis direction from the pivoting shaft of the secondary transfer counter roller 106. As the urging member 138, for example, a spring such as an extension coil spring is used. As the urging member 138, a torsional spring may be used as well as a coil spring.

A bulge portion 139 is provided in the hook 137 of the first holding member 135. The bulge portion 139 is preferably provided at a position in the +X axis direction from the other end of the urging member 138. The bulge portion 139 protrudes from the first holding member 135 in a direction intersecting a central axis of a rotating shaft 162 parallel to the Y axis of the secondary transfer roller 160. In the embodiment, the bulge portion 139 protrudes from the first holding member 135 in the +Y axis direction. The bulge portion 139 can be formed in any of various shapes and preferably has, for example, a columnar shape with a central axis in the Y axis.

As illustrated in FIG. 5, a second base 124 is provided in the transfer unit body 100 of the transfer unit 82. The second base 124 may be integrated with the transfer unit body 100. The second base 124 covers at least a part of the rear side portion (an −Y axis side end) of each of the transfer belt 102, the secondary transfer counter roller 106, and the belt suspended roller 110. In the embodiment, the second base 124 covers the −Y axis side end which is the rear side portion of the pivoting shaft 1061 of the secondary transfer counter roller 106. The second base 124 faces the rear frame 34 of the apparatus body 12. The rear frame 34 may support the second base 124 along with the transfer unit body 100 or instead of the transfer unit body 100.

The second base 124 includes a second extension portion 125 extending toward the side cover 14. The second extension portion 125 is provided at the −Y axis side end which is the rear side portion of the secondary transfer counter roller 106. The second extension portion 125 includes a support surface (a guide surface) 1251 that supports a shaft end member 167. The support surface 1251 is formed as a slope surface or a curved surface extending in the +X axis direction and the −Z axis direction. The support surface (a guide surface) 1251 is preferably formed with the same size as the support surface 1231 of the first extension portion 123 on the front side at a position parallel to the Y axis direction.

In the second base 124, a second holding member 145 that pivots with respect to the second base 124 is supported. The second holding member 145 pivots around the same pivoting shaft as the pivoting shaft 1061 of the secondary transfer counter roller 106, for example. Therefore, the pivoting shaft of the first holding member 135 and the second holding member 145 is the same shaft as the pivoting shaft 1061 of the secondary transfer counter roller 106.

The second holding member 145 includes a pivoting body 146 that pivots around the shaft of the secondary transfer counter roller 106 and a hook 147 that is provided in the pivoting body 146, extends from the pivoting body 146 to the side cover 14, that is, in the +X axis direction, and holds the shaft end member 167 from the upper side. The hook 147 includes a recessed surface 1471 that holds the shaft end member 167 of the secondary transfer roller 160 interposed with the support surface 1251 of the second extension portion 125 and a protrusion 1472 that extends toward the −Z axis side on the +X axis side of the recessed surface 1471.

An urging member 148 that supports the second holding member 145 with respect to the second base 124 is provided between the second base 124 and the second holding member 145. One end of the urging member 148 is held at a position on the −X axis direction from the pivoting shaft of the secondary transfer counter roller 106. The other end of the urging member 148 is supported at a position in the +X axis direction and the +Z axis direction from the pivoting shaft of the secondary transfer counter roller 106. As the urging member 148, for example, a spring such as a torsional spring is used. As the urging member 148, an extension coil spring may be used as well as a torsional spring.

A bulge portion 149 is provided in the hook 147 of the second holding member 145. The bulge portion 149 is preferably provided at a position in the +X axis direction from the other end of the urging member 148. The bulge portion 149 protrudes from the second holding member 145 in a direction intersecting a central axis of the rotating shaft 162 of the secondary transfer roller 160. In the embodiment, the bulge portion 149 protrudes from the second holding member 145 in the −Y axis direction. The bulge portion 149 can be formed in any of various shapes and preferably has, for example, a columnar shape with a central axis in the Y axis.

The recessed surface 1471 of the hook 147 is formed with the same size and shape as the recessed surface 1371 of the hook 137 and is separated therefrom in parallel on the Y axis. The bulge portion 149 is formed with the same size as the bulge portion 139 and is separated therefrom in parallel on the Y axis. The shape of the hook 147 may be different from the shape of the hook 137.

The first holding member 135 and the second holding member 145 hold the shaft end members 166 and 167 and are formed of an appropriate material which is rarely deformed if an appropriate pressurization force is added between the secondary transfer roller 160 and the transfer belt 102 on the secondary transfer counter roller 106. The first holding member 135 and the second holding member 145 are formed of, for example, an appropriate material such as a resin material or a metal material.

As illustrated in FIGS. 6 to 9, the secondary transfer roller unit 84 of the printer 20 is provided in the side cover 14. The side cover 14 pivots around the predetermined openable shaft 141 to be opened and closed with respect to the apparatus body 12.

As illustrated in FIG. 3, the secondary transfer roller unit 84 includes the secondary transfer roller 160 and a secondary transfer roller frame 165 that holds the secondary transfer roller 160.

The secondary transfer roller 160 forms the secondary transfer unit that transfers a toner image primarily transferred to the transfer belt 102 to the sheet 44 in cooperation with the secondary transfer counter roller 106. The secondary transfer roller 160 moves between an abutting position at which the secondary transfer roller 160 comes into contact with the transfer belt 102 and interposes the transfer belt 102 along with the secondary transfer counter roller 106 and a separate position at which the secondary transfer roller 160 is separated from the transfer belt 102. The secondary transfer roller 160 faces the secondary transfer counter roller 106 with the transfer belt 102 interposed therebetween. The outer circumferential surface of the secondary transfer roller 160 comes into contact with the transfer belt 102. The secondary transfer roller 160 follows the circulation of the transfer belt 102 to rotate. A transfer bias is given between the secondary transfer roller 160 and the secondary transfer counter roller 106. The secondary transfer roller 160 transfers the toner image on the transfer belt 102 to the sheet 44.

The secondary transfer roller frame 165 includes a first conveyance guide unit 172 in a lower portion of the lateral surface on the −X axis side. The secondary transfer roller frame 165 includes a second conveyance guide unit 174 in an upper portion of the lateral surface on the −X axis side.

The first conveyance guide unit 172 forms a part of the conveyance unit 24 in cooperation with the apparatus body 12 upon closing the side cover 14 with respect to the apparatus body 12 and serves as a guide for conveying the sheet 44 to the printer 20. The second conveyance guide unit 174 forms a part of the conveyance unit 24 in cooperation with the apparatus body 12 upon closing the side cover 14 with respect to the apparatus body 12 and serves as a guide for conveying the sheet 44 from the printer 20 to the fixing unit 86.

The secondary transfer roller frame 165 includes a secondary transfer roller holding portion 176 between the first conveyance guide unit 172 and the second conveyance guide unit 174. The secondary transfer roller holding portion 176 is opened in the −X axis direction and is formed in a recessed shape to accept the secondary transfer roller 160.

The secondary transfer roller frame 165 holds the secondary transfer roller 160 so that the secondary transfer roller 160 is pivoted around the shaft of the rotating shaft 162 in the Y axis direction. The secondary transfer roller frame 165 is supported by the side cover 14. Therefore, the secondary transfer roller 160 moves to the apparatus body 12 along with the side cover 14.

As illustrated in FIGS. 4 and 6 to 9, the secondary transfer roller unit 84 includes the first shaft end member 166 provided at a shaft end of the rotating shaft 162 on the front side (the +Y axis side) of the secondary transfer roller 160 along the Y axis. The first shaft end member 166 includes an inner wheel 1661 and an outer wheel 1662 that is provided outside of the inner wheel 1661 and rotates relative to the inner wheel 1661. The inner wheel 1661 and the outer wheel 1662 are disposed concentrically. The inner wheel 1661 is fixed at, for example, the shaft end of the rotating shaft 162 of the secondary transfer roller 160 and rotates with the rotations of the rotating shaft 162.

As illustrated in FIG. 5, the secondary transfer roller unit 84 includes the second shaft end member 167 provided at the shaft end on the rear side (the −Y axis side) of the rotating shaft 162 of the secondary transfer roller 160 along the Y axis. The second shaft end member 167 includes an inner wheel 1671 and an outer wheel 1672 that is provided outside of the inner wheel 1671 and rotates relative to the inner wheel 1671. The inner wheel 1671 and the outer wheel 1672 are disposed concentrically. The inner wheel 1671 is fixed at, for example, the shaft end of the rotating shaft 162 of the secondary transfer roller 160 and rotates with the rotations of the rotating shaft 162.

The first shaft end member 166 and the second shaft end member 167 are fixed to the same rotating shaft 162. Therefore, the inner wheel of the first shaft end member 166 and the inner wheel of the second shaft end member 167 rotate together. The outer wheel of the first shaft end member 166 and the outer wheel of the second shaft end member 167 are formed with the same outer diameter.

As illustrated in FIGS. 4 and 5, the buffer unit 181 is provided in the side cover 14. The buffer unit 181 pivots around the shaft parallel to the openable shaft 141 of the side cover 14, but a pivoting center of the buffer unit 181 is different from a pivoting center of the openable shaft 141 of the side cover 14. The buffer unit 181 pivots around the shaft parallel to the openable shaft 141 of the side cover 14 to buffer a collision between the secondary transfer counter roller 106 and the secondary transfer roller 160 if the side cover 14 is closed with respect to the apparatus body 12.

The buffer unit 181 includes a front side frame 182 of the secondary transfer roller unit 84 on the front side (the +Y axis side). The front side frame 182 includes a first groove 1811 and a second groove 1812. The first groove 1811 engages with a first protrusion portion 841 of the secondary transfer roller unit 84 that protrudes to the front side (the +Y axis side). The first groove 1811 is formed as a through hole that is large with respect to the first protrusion portion 841. The second groove 1812 engages with a second protrusion portion 842 of the secondary transfer roller unit 84 that protrudes to the front side (the +Y axis side). The second groove 1812 is formed as a through hole that is large with respect to the second protrusion portion 842. The extension direction of the first groove 1811 and the extension direction of the second groove 1812 may be parallel along the ZX plane or may be different.

As illustrated in FIG. 6, the buffer unit 181 includes a rear side frame 183 of the secondary transfer roller unit 84 on the rear side (the −Y axis side). The front side frame 182 and the rear side frame 183 are connected. The rear side frame 183 includes a third groove 1813 and a fourth groove 1814 on the rear side (the −Y axis side) of the secondary transfer roller unit 84.

The third groove 1813 engages with a third protrusion portion 843 of the secondary transfer roller unit 84 that protrudes to the rear side (the −Y axis side). The third groove 1813 is formed as a through hole that is large with respect to the third protrusion portion 843. The fourth groove 1814 engages with a fourth protrusion portion 844 of the secondary transfer roller unit 84 that protrudes to the rear side (the −Y axis side). The fourth groove 1814 is formed as a through hole that is large with respect to the fourth protrusion portion 844.

The extension direction of the third groove 1813 and the extension direction of the fourth groove 1814 may be parallel along the ZX plane or may be different. The third protrusion portion 843 is disposed at the same axis as the first protrusion portion 841 in parallel to the Y axis. The third groove 1813 is formed with the same shape and size as the first groove 1811 in parallel to the Y axis. The fourth protrusion portion 844 is disposed at the same axis as the second protrusion portion 842 in parallel to the Y axis. The fourth groove 1814 is formed with the same shape and size as the second groove 1812 in parallel to the Y axis. Therefore, the buffer unit 181 moves to the secondary transfer roller unit 84 within a predetermined range.

A first guide 191 and a second guide 192 are provided in the side cover 14. In the embodiment, the first guide 191 and the second guide 192 are fixed or integrated to, for example, the buffer unit 181. For example, the first guide 191 is fixed or integrated to the front side frame 182. The second guide 192 is fixed or integrated to the rear side frame 183.

The first guide 191 is disposed on the front side (the +Y axis side) closer than the front side end of the shaft end member 166 and the rotating shaft 162. The second guide 192 is disposed on the rear side (the −Y axis side) closer than the rear side end of the shaft end member 167 and the rotating shaft 162.

As illustrated in FIGS. 6 to 11, the first guide 191 includes a groove portion 1911 that has a left side (the −X axis side) serving as an entrance 1912 and a right side (the +X axis side) serving as a blocking end 1913. The groove portion 1911 is formed with a size so that the bulge portion 139 is slid in and out. The groove portion 1911 includes a pair of guide surfaces 19111 and 19112 that face each other. The pair of guide surfaces 19111 and 19112 are separated in the Z axis direction so that the bulge portion 139 is slid in and out. One guide surface 19111 is disposed above the other guide surface 19112. The pair of guide surfaces 19111 and 19112 are formed as, for example, a curved surface or a planar surface. The pair of guide surfaces 19111 and 19112 may be formed by combining a curved surface and a planar surface. The position of the groove portion 1911 in the front and rear directions (the position in the Y axis direction) is a position at which the bulge portion 139 can be accepted without interfering in the first holding member 135 and the urging member 138.

The groove portion 1911 moves along with the buffer unit 181 by pivoting around the openable shaft 141 of the side cover 14. The groove portion 1911 is disposed at a position at which the bulge portion 139 is pressurized to the lower side (the −Z axis side) by the guide surface 19111 if the side cover 14 is closed with respect to the apparatus body 12. Since the entrance 1912 brings the bulge portion 139 into contact with the guide surface 19111, the left end (the −X axis side end) of the guide surface 19111 protrudes to the left side (the −x axis side) further than the left side end (the −X axis side end) of the guide surface 19112. The guide surface 19111 is formed in a shape in which the left end of the guide surface 19111 protrudes to the left side further than the central axis of the bulge portion 139 if the bulge portion 139 comes into contact with the guide surface 19111. A protrusion amount of the guide surface 19111 to the left side with respect to the guide surface 19112 is preferably equal to or larger than the diameter of the bulge portion 139.

The groove portion 1911 is disposed at a position to which the hook 137 is lowered at a position at which the side cover 14 is closed with respect to the apparatus body 12 by the pivoting around the openable shaft 141 of the side cover 14. The blocking end 1913 is preferably formed in a shape in which the bulge portion 139 does not come into contact with the blocking end 1913.

The groove portion 1911 is disposed due to the pivoting around the openable shaft 141 of the side cover 14 at a position to which the bulge portion 139 is pressurized to the upper side (the +Z axis side) by the guide surface 19112 if the side cover 14 is opened with respect to the apparatus body 12. The groove portion 1911 is disposed at a position to which the hook 137 is raised at a position at which the side cover 14 is opened with respect to the apparatus body 12 by the pivoting around the openable shaft 141 of the side cover 14.

As illustrated in FIGS. 12 and 13, the second guide 192 includes a groove portion 1921 that has a left side (the −X axis side) serving as an entrance 1922 and a right side (the +X axis side) serving as a blocking end 1923. The groove portion 1921 is formed with a size so that the bulge portion 149 is slid in and out. The groove portion 1921 includes a pair of guide surfaces 19211 and 19212 that face each other. The pair of guide surfaces 19211 and 19212 are separated in the Z axis direction so that the bulge portion 149 is slid in and out. One guide surface 19211 is disposed above the other guide surface 19212. The pair of guide surfaces 19211 and 19212 are formed as, for example, a curved surface or a planar surface. The pair of guide surfaces 19211 and 19212 may be formed by combining a curved surface and a planar surface. The position of the groove portion 1921 in the front and rear directions (the position in the Y axis direction) is a position at which the bulge portion 149 can be accepted without interfering in the second holding member 145 and the urging member 148.

The groove portion 1921 is separated in the Y axis direction with the same size and shape as the groove portion 1911.

As illustrated in FIG. 1, the fixing unit 86 is above the transfer unit 82 and the secondary transfer roller unit 84. The fixing unit 86 provides heat and pressurization to the sheet 44 to which toner images are secondarily transferred. The fixing unit 86 fixes the toner images secondarily transferred to the sheet 44 by the heat and the pressurization.

The sheet 44 is provided above the fixing unit 86 and is discharged to the discharging tray 28 on which the sheet 44 is put.

Next, an operation of the image forming apparatus 10 will be described.

As illustrated in FIG. 6, if the side cover 14 is opened to the +X axis side with respect to the apparatus body 12, the side cover 14 is pivoted around the predetermined openable shaft 141 parallel to the Y axis. The secondary transfer roller unit 84 and the buffer unit 181 which are portions of the conveyance unit 24 on the +X axis side are moved along with the side cover 14. At this time, the secondary transfer roller 160 is at the separate position at which the secondary transfer roller 160 is separated from the transfer belt 102.

At this time, as illustrated in FIGS. 4 and 6, the bulge portion 139 of the first holding member 135 is separated from the groove portion 1911. As illustrated in FIG. 5, the bulge portion 149 of the second holding member 145 is separated from the groove portion 1921. At this time, the hook 137 and the bulge portion 139 are disposed above the pivoting shaft 1061 of the first holding member 135 by an urging force of the urging member 138. The protrusion 1372 of the hook 137 is disposed above the upper end of the outer circumferential surface of the shaft end member 166 along the Z axis. The hook 147 and the bulge portion 149 are disposed above the pivoting shaft 1061 of the second holding member 145 by an urging force of the urging member 148. The protrusion 1472 of the hook 147 is disposed above the upper end of the outer circumferential surface of the shaft end member 167 along the Z axis.

If the side cover 14 is closed from the position illustrated in FIGS. 4 to 6 with respect to the apparatus body 12, the side cover 14 is pivoted around the predetermined openable shaft 141 parallel to the Y axis. Accordingly, the secondary transfer roller 160 is moved toward the transfer belt 102 and the secondary transfer counter roller 106.

At this time, on the front side, as illustrated in FIG. 7, the bulge portion 139 comes into contact with the upper side guide surface 19111 of the groove portion 1911 and the outer circumferential surface of the shaft end member 166 comes into contact with the support surface 1231 of the first extension portion 123. The shaft end member 166 is moved to the left side (the −X axis side) so that the rotating shaft 162 of the secondary transfer roller 160 becomes close to the pivoting shaft 1061 of the pivoting body 136 of the first holding member 135. The bulge portion 139 is pressurized to the lower side by the upper side guide surface 19111 of the groove portion 1911 so that the shaft end member 166 and the recessed surface 1371 of the hook 137 are closed.

At this time, on the rear side, as illustrated in FIG. 12, the bulge portion 149 also comes into contact with the upper side guide surface 19211 of the groove portion 1921. The shaft end member 167 is moved to the left side (the −X axis side) so that the rotating shaft 162 of the secondary transfer roller 160 becomes close to the pivoting shaft 1061 of the pivoting body 146 of the second holding member 145. The bulge portion 149 is pressurized to the lower side by the upper side guide surface 19211 of the groove portion 1921 so that the shaft end member 167 and the recessed surface 1471 of the hook 147 are closed.

On the front side, as illustrated in FIG. 8, if the shaft end member 166 is supported by the support surface 1231 of the first extension portion 123, the bulge portion 139 is entered between the guide surfaces 19111 and 19112 of the groove portion 1911 while pressurized to the lower side by the upper side guide surface 19111 of the groove portion 1911, and is moved relatively toward the blocking end 1913. On the rear side, if the shaft end member 167 is supported by the support surface 1251 of the second extension portion 125, the bulge portion 149 is also entered between the guide surfaces 19211 and 19212 of the groove portion 1921 while pressurized to the lower side by the guide surface 19211 of the groove portion 1921, and is moved relatively toward the blocking end 1923 of the groove portion 1921.

On the front side, as illustrated in FIGS. 9 and 11, before the bulge portion 139 arrives at the blocking end 1913 of the groove portion 1911 in the state in which the shaft end member 166 is supported by the support surface 1231 of the first extension portion 123, the recessed surface 1371 of the hook 137 holds the outer circumferential surface of the shaft end member 166. At this time, as illustrated in FIG. 14, the rotating shaft 162 of the secondary transfer roller 160 becomes closest to the pivoting shaft 1061 of the pivoting body 136 of the first holding member 135. At the position at which the recessed surface 1371 of the hook 137 holds the outer circumferential surface of the shaft end member 166, the bulge portion 139 becomes closest to the blocking end 1913 of the groove portion 1911.

As the hook 137 is lowered from the raised position, the protrusion 1372 of the hook 137 comes into contact with the outer wheel 1662 of the shaft end member 166. The hook 137 is evacuated above the outer circumferential surface of the shaft end member 166 until the central axis of the shaft end member 166 is moved toward the lower end of the protrusion 1372 of the hook 137 from the right side (the +X axis side) to the left side (the −X axis side). If the abutting position of the protrusion 1372 of the hook 137 to the outer wheel 1662 of the shaft end member 166 is on the right side (the +X axis side) of the central axis of the shaft end member 166, the protrusion 1372 of the hook 137 pressurizes the shaft end member 166 to the left side (the −X axis side) as the hook 137 is lowered. Therefore, the shaft end member 166 is guided to the recessed surface 1371 of the hook 137. The outer circumferential surface of the shaft end member 166 is held on the recessed surface 1371 of the hook 137.

On the rear side, before the bulge portion 149 arrives at the blocking end 1923 of the groove portion 1921 in the state in which the shaft end member 167 is supported by the support surface 1251 of the second extension portion 125, the recessed surface 1471 of the hook 147 holds the outer circumferential surface of the shaft end member 167. At this time, the rotating shaft 162 of the secondary transfer roller 160 becomes closest to the pivoting shaft 1061 of the pivoting body 146 of the second holding member 145. At the position at which the recessed surface 1471 of the hook 147 holds the outer circumferential surface of the shaft end member 167, the bulge portion 149 becomes closest to the blocking end 1923 of the groove portion 1921.

As the hook 147 is lowered from the raised position, the protrusion 1472 of the hook 147 comes into contact with the outer wheel 1672 of the shaft end member 167. The hook 147 is evacuated above the outer circumferential surface of the shaft end member 167 until the central axis of the shaft end member 167 is moved toward the lower end of the protrusion 1472 of the hook 147 from the right side (the +X axis side) to the left side (the −X axis side). If the abutting position of the protrusion 1472 of the hook 147 to the outer wheel 1672 of the shaft end member 167 is on the right side (the +X axis side) of the central axis of the shaft end member 167, the protrusion 1472 of the hook 147 pressurizes the shaft end member 167 to the left side (the −X axis side) as the hook 147 is lowered. Therefore, the shaft end member 167 is guided to the recessed surface 1471 of the hook 147. The outer circumferential surface of the shaft end member 167 is held on the recessed surface 1471 of the hook 147.

In this way, in the image forming apparatus 10 according to the embodiment, upon closing the side cover 14, the hook 137 holds the shaft end member 166 of the secondary transfer roller 160 and the hook 147 holds the shaft end member 167 of the secondary transfer roller 160. At this time, the secondary transfer roller 160 comes into contact with the transfer belt 102 and moves to the abutting position at which the secondary transfer roller 160 interposes the transfer belt 102 along with the secondary transfer counter roller 106. Therefore, it is possible to prevent a distance between the secondary transfer roller 160 and the transfer belt 102 on the secondary transfer counter roller 106 from being separated by a predetermined distance or more. In the image forming apparatus 10 according to the embodiment, a pressurized state is realized between the secondary transfer counter roller 106 and the secondary transfer roller 160. Therefore, for example, even when a sheet such as a thick sheet with strong rigidity is conveyed, a pressurization force appropriate for a sheet passing between the secondary transfer roller 160 and the secondary transfer counter roller 106 is caused.

Accordingly, in the image forming apparatus 10 according to the embodiment, it is possible to ensure an appropriate nip between the secondary transfer roller 160 and the transfer belt 102 on the secondary transfer counter roller 106. If a thin sheet is conveyed, an appropriate pressurization force is caused between the secondary transfer counter roller 106 and the secondary transfer roller 160. Accordingly, in the image forming apparatus 10 according to the embodiment, if sheets with various thicknesses are used, it is possible to ensure an appropriate transfer nip between the secondary transfer roller 160 and the transfer belt 102 on the secondary transfer counter roller 106.

If the side cover 14 is closed with respect to the apparatus body 12, the outer surface of the side cover 14 on the +X axis side is inclined at substantially the same angle on the Z axis at the position illustrated in FIGS. 7 and 8. However, a positional relation between the groove portion 1911 and the bulge portion 139 is different. The difference in the positional relation arises due to the buffer unit 181 illustrated in FIGS. 4 and 5. For example, as illustrated in FIG. 4, at the position at which the groove portion 1911 is separated from the bulge portion 139, the first protrusion portion 841 is located on the −X axis side with respect to the first groove 1811. The second protrusion portion 842 is located on the −X axis side with respect to the second groove 1812. If the groove portion 1911 comes into contact with the bulge portion 139, the first protrusion portion 841 is moved to the position on the +X axis side with respect to the first groove 1811 and the second protrusion portion 842 is moved to the position on the +X axis side with respect to the second groove 1812.

After the first protrusion portion 841 is moved to the position on the +X axis side with respect to the first groove 1811 and the second protrusion portion 842 is moved to the position on the +X axis side with respect to the second groove 1812, the guide surface 19111 of the groove portion 1911 adds a pressurization force to the bulge portion 139. Accordingly, if the side cover 14 is closed with respect to the apparatus body 12, the side cover 14 is buffered by the buffer unit 181 and is then closed. Therefore, if the side cover 14 is closed with respect to the apparatus body 12, it is possible to prevent a large force from being abruptly loaded between the secondary transfer counter roller 106 and the secondary transfer roller 160 of the secondary transfer roller unit 84 in the image forming apparatus 10.

The side cover 14 is opened from the position illustrated in FIG. 9 to the position illustrated in FIG. 6 with respect to the apparatus body 12. On the front side, the lower side guide surface 19112 of the groove portion 1911 is relatively moved from the blocking end 1913 to the entrance 1912 while pushing the bulge portion 139 upward along the Z axis. Therefore, the hook 137 opens the shaft end member 166. At this time, the contact of the shaft end member 166 with the support surface 1231 of the first extension portion 123 is released. Then, the bulge portion 139 is withdrawn from the entrance 1912 of the groove portion 1911 through the groove portion 1911. The urging member 138 holds the first holding member 135 in the state illustrated in FIGS. 4 and 6.

The side cover 14 is opened from the position illustrated in FIG. 9 to the position illustrated in FIG. 6 with respect to the apparatus body 12. On the rear side, the lower side guide surface 19212 of the groove portion 1921 is relatively moved from the blocking end 1923 to the entrance 1922 while pushing the bulge portion 149 upward along the Z axis. Therefore, the hook 147 opens the shaft end member 167. At this time, the contact of the shaft end member 167 with the support surface 1251 of the second extension portion 125 is released. Then, the bulge portion 149 is withdrawn from the entrance 1922 of the groove portion 1921 through the groove portion 1921. The urging member 148 holds the second holding member 145 in the state illustrated in FIG. 5.

In the image forming apparatus 10 according to the embodiment, in an operation of forming an image, the shaft end member 166 of the secondary transfer roller 160 is held by the first holding member 135 of the transfer unit 82, and the shaft end member 167 of the secondary transfer roller 160 is held by the second holding member 145 of the transfer unit 82. Therefore, it is possible to adjust a maximum gap between the secondary transfer roller 160 and the transfer belt 102 on the secondary transfer counter roller 106. Therefore, in the image forming apparatus 10 according to the embodiment, the pressurization can be realized between the secondary transfer roller 160 and the transfer belt 102 on the secondary transfer counter roller 106 without depending on the pressurization force of the elastic member such as a spring between the secondary transfer roller 160 and the secondary transfer counter roller 106.

For example, if a sheet such as a suitable thick sheet with strong rigidity is conveyed between the transfer belt 102 and the secondary transfer roller 160, the pressurization to the transfer belt 102 between the secondary transfer roller 160 and the secondary transfer counter roller 106 is also maintained. If a sheet with strong rigidity is conveyed, a transfer nip necessary for transfer can be ensured for a sheet between the transfer belt 102 and the secondary transfer roller 160 by using the image forming apparatus 10 according to the embodiment. In the image forming apparatus 10 according to the embodiment, countermeasures for raising the pressurization force of the elastic member are not necessary. Therefore, countermeasures for raising strength of constituent elements related to the elastic member are not necessary either. Accordingly, in the image forming apparatus 10 according to the embodiment, it is possible to inhibit an increase in a weight associated with an increase in the strength of the constituent elements.

In the embodiment, the buffer unit 181 is provided in the side cover 14. Therefore, if the side cover 14 is closed with respect to the apparatus body 12, it is possible to prevent a large force from being abruptly loaded between the secondary transfer counter roller 106 and the secondary transfer roller 160 of the secondary transfer roller unit 84 in the image forming apparatus 10.

In the image forming apparatus 10 according to the embodiment, as exemplified above, the buffer unit 181 is provided in the side cover 14 and the buffer unit 181 can be moved to the side cover 14 and the secondary transfer roller unit 84 within the predetermined range. The buffer unit 181 may not be provided in the image forming apparatus 10. In this case, for example, the guides 191 and 192 are fixed or integrated to the side cover 14. At this time, the pivoting centers of the guides 191 and 192 are the openable shaft 141 of the side cover 14. By appropriately forming the groove portions 1911 and 1921 of the guides 191 and 192, the grooves 1911 and 1921 of the guides 191 and 192 can move the first holding member 135 and the second holding member 145 in response to the opening and closing of the side cover 14. Therefore, the first holding member 135 and the second holding member 145 can hold the shaft end members 166 and 167 if the side cover 14 is closed, and can open the shaft end members 166 and 167 if the side cover 14 is opened.

In the embodiment, as exemplified above, the bulge portion 139 is located on the +Y axis side of the first holding member 135. For example, if the groove portion 1911 and the first base 122, and the first holding member 135 are disposed in the positional relation in which no interference occurs, the bulge portion 139 preferably protrudes on the −Y axis side to the first holding member 135. Further, if the groove portion 1911 is formed at a position at which the groove portion 1911 does not interfere in the components of the transfer unit 82 and other components of the image forming apparatus 10, the bulge portion 139 and the groove portion 1911 can prevent an increase in the image forming apparatus 10 on the front side.

Similarly, as exemplified above, the bulge portion 149 is located on the −Y axis side of the second holding member 145. For example, if the groove portion 1921 and the second base 124, and the second holding member 145 are disposed in the positional relation in which no interference occurs, the bulge portion 149 preferably protrudes on the +Y axis side to the second holding member 145. Further, if the groove portion 1921 is formed at a position at which the groove portion 1921 does not interfere in the components of the transfer unit 82 and other components of the image forming apparatus 10, the bulge portion 149 and the groove portion 1921 can prevent an increase in the image forming apparatus 10 on the rear side.

According to at least one of the above-described embodiments, it is possible to provide the image forming apparatus in which the appropriate transfer nip is ensured for a suitable sheet conveyed between the secondary transfer roller and the transfer belt on the secondary transfer counter roller without depending on the pressurization force of the elastic member.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an apparatus body;

a transfer unit body;

a transfer counter roller supported by the transfer unit body;

a transfer belt suspended on the transfer counter roller and on which an image is formed;

a side cover openable and closeable with respect to the apparatus body;

a transfer roller supported by the side cover, configured to move between an abutting position at which the transfer roller comes into contact with the transfer belt and interposes the transfer belt along with the transfer counter roller and a separate position at which the transfer roller is separated from the transfer belt, and configured to pivot with respect to the side cover;

a shaft end member provided at a shaft end of the transfer roller; and a holding member provided in the transfer unit body, configured to hold the shaft end member at the abutting position and open the shaft end member at the separate position.

2. The image forming apparatus according to claim 1, wherein the holding member comprises a pivoting body configured to pivot with respect to the transfer unit body, and a hook provided in the pivoting body configured to hold the shaft end member from an upper side.

3. The image forming apparatus according to claim 2, wherein a pivoting shaft of the holding member is also a pivoting shaft of the transfer counter roller.

4. The image forming apparatus according to claim 1, further comprising:

a guide surface that extends from the transfer unit body to the side cover and supports the shaft end member.

5. The image forming apparatus according to claim 1, further comprising:

an urging member provided between the transfer unit body and the holding member and configured to urge the holding member toward the transfer unit body.

6. The image forming apparatus according to claim 1, further comprising:

a bulge portion provided in the holding member and configured to protrude from the holding member to a front side or a rear side; and a guide provided in the side cover and configured to engage the bulge portion at the abutting position and separate the bulge portion at the separate position.

7. The image forming apparatus according to claim 6, wherein the guide comprises a groove portion configured to accept the bulge portion.

8. The image forming apparatus according to claim 6, further comprising:

a buffer component configured to fix or integrate with the guide to pivot around a shaft parallel to the side cover, and provided in the side cover to buffer a collision between the transfer counter roller and the transfer roller if the side cover is closed with respect to the apparatus body.

9. The image forming apparatus according to claim 8, wherein the buffer component is different from the side cover in a pivoting center.

10. The image forming apparatus according to claim 1, wherein the shaft end member comprises an inner wheel which rotates with rotation of the transfer roller and an outer wheel which is provided outside of the inner wheel and rotates relative to the inner wheel.

11. A method for an image forming apparatus, comprising:

moving a transfer roller supported by a side cover openable and closeable with respect to an apparatus body between an abutting position at which the transfer roller comes into contact with a transfer belt suspended on a transfer counter roller and interposes the transfer belt along with the transfer counter roller and a separate position at which the transfer roller is separated from the transfer belt;

pivoting the transfer roller with respect to the side cover;

holding a shaft end member provided at a shaft end of the transfer roller at the abutting position with a holding member; and opening the shaft end member at the separate position.

12. The method according to claim 11, wherein the holding member comprises a pivoting body configured to pivot with respect to the transfer unit body, and a hook provided in the pivoting body configured to hold the shaft end member from an upper side.

13. The method according to claim 11, further comprising:

a guide surface that extends from the transfer unit body to the side cover and supports the shaft end member.

14. The method according to claim 11, further comprising:

an urging member provided between the transfer unit body and the holding member and configured to urge the holding member toward the transfer unit body.

15. The method according to claim 11, further comprising:

a bulge portion provided in the holding member and configured to protrude from the holding member to a front side or a rear side; and a guide provided in the side cover and configured to engage the bulge portion at the abutting position and separate the bulge portion at the separate position.

16. The method according to claim 15, further comprising:

a buffer component configured to fix or integrate with the guide to pivot around a shaft parallel to the side cover, and provided in the side cover to buffer a collision between the transfer counter roller and the transfer roller if the side cover is closed with respect to the apparatus body.

17. A roller assembly, comprising:

a transfer belt suspended on a transfer counter roller and on which an image is formed;

a side cover openable and closeable;

a transfer roller supported by the side cover, configured to move between an abutting position at which the transfer roller comes into contact with the transfer belt and interposes the transfer belt along with the transfer counter roller and a separate position at which the transfer roller is separated from the transfer belt, and configured to pivot with respect to the side cover;

a shaft end member provided at a shaft end of the transfer roller; and a holding member configured to hold the shaft end member at the abutting position and open the shaft end member at the separate position.

18. The roller assembly according to claim 17, wherein the holding member comprises a pivoting body configured to pivot, and a hook provided in the pivoting body configured to hold the shaft end member from an upper side.

19. The roller assembly according to claim 18, wherein a pivoting shaft of the holding member is also a pivoting shaft of the transfer counter roller.

20. The roller assembly according to claim 17, wherein the shaft end member comprises an inner wheel which rotates with rotation of the transfer roller and an outer wheel which is provided outside of the inner wheel and rotates relative to the inner wheel.

* * * * *